US008668604B2

(12) United States Patent
Stemle

(10) Patent No.: US 8,668,604 B2
(45) Date of Patent: Mar. 11, 2014

(54) THROWING TARGET, SYSTEM, AND METHOD

(71) Applicant: Stephen Joseph Stemle, Lanesville, IN (US)

(72) Inventor: Stephen Joseph Stemle, Lanesville, IN (US)

( * ) Notice: Subject to any disclaimer, the term of this patent is extended or adjusted under 35 U.S.C. 154(b) by 0 days.

(21) Appl. No.: 13/921,170

(22) Filed: Jun. 18, 2013

(65) Prior Publication Data

US 2013/0281235 A1 Oct. 24, 2013

Related U.S. Application Data

(62) Division of application No. 12/829,301, filed on Jul. 1, 2010.

(51) Int. Cl.
*A63B 69/00* (2006.01)

(52) U.S. Cl.
USPC ..... 473/456

(58) Field of Classification Search
USPC ..... 473/451–456; 273/398–402, 409
See application file for complete search history.

(56) References Cited

U.S. PATENT DOCUMENTS

| | | | | |
|---|---|---|---|---|
| 1,592,005 | A | 7/1926 | Rovane | |
| 1,652,062 | A | 12/1927 | Stauffer | |
| 2,059,365 | A | 11/1936 | King | |
| 2,254,986 | A | 9/1941 | Ziel | |
| 2,873,969 | A | 2/1959 | Ziel | |
| 3,583,703 | A | 6/1971 | Brown et al. | |
| 3,810,616 | A | 5/1974 | Murphy | |
| 3,997,158 | A | 12/1976 | Britton | |
| 4,254,952 | A | 3/1981 | Playter, Jr. | |
| 4,497,485 | A | 2/1985 | Macosko | |
| 4,563,005 | A | 1/1986 | Hand et al. | |
| 4,629,188 | A | 12/1986 | Mahieu | |
| 4,643,423 | A | 2/1987 | Wright | |
| 4,770,527 | A * | 9/1988 | Park | 356/28 |
| 4,781,376 | A | 11/1988 | Barnes, Sr. | |
| 4,830,369 | A * | 5/1989 | Poitras | 473/455 |
| 4,872,674 | A | 10/1989 | Deal | |
| 4,930,774 | A * | 6/1990 | Butcher | 473/456 |
| 5,046,729 | A | 9/1991 | Yancey | |
| 5,064,194 | A * | 11/1991 | Bixler et al. | 473/436 |
| D330,920 | S | 11/1992 | Schaefer et al. | |
| D331,426 | S | 12/1992 | Riffle et al. | |
| D350,569 | S | 9/1994 | Boteler | |
| 5,348,291 | A | 9/1994 | Scully | |
| 5,419,549 | A * | 5/1995 | Galloway et al. | 473/431 |
| 5,433,434 | A | 7/1995 | Helmetsie | |
| 5,439,211 | A | 8/1995 | Drabowsky | |
| D375,528 | S | 11/1996 | Raines et al. | |
| 5,573,240 | A | 11/1996 | Humboldt | |
| 5,803,842 | A | 9/1998 | Ross | |
| 6,155,936 | A | 12/2000 | Dorr | |
| 6,878,078 | B2 | 4/2005 | Swanson | |
| 7,179,179 | B2 | 2/2007 | McDaniel | |
| D597,155 | S * | 7/2009 | Stemle | D21/699 |
| 8,142,267 | B2 * | 3/2012 | Adams | 463/2 |
| 2006/0035731 | A1 * | 2/2006 | Husband | 473/422 |
| 2008/0103997 | A1 * | 5/2008 | Fein et al. | 706/12 |

* cited by examiner

*Primary Examiner* — Mark Graham
(74) *Attorney, Agent, or Firm* — The Compton Law Firm, P.C.; Scott D. Compton

(57) ABSTRACT

The present application is directed to a throwing target method. The throwing target comprises a baseball strike zone, one or more target zones located in the strike zone and one or more target zones located around the strike zone. The throwing target also comprises one or more non-target zones located in the strike zone. The total surface area of the target zones located around the strike zone is greater than the total surface area of the target zones located within the strike zone.

10 Claims, 10 Drawing Sheets

THROWING TARGET, SYSTEM, AND METHOD

CROSS-REFERENCE TO RELATED APPLICATIONS

This application is a divisional application of U.S. Patent Office application Ser. No. 12/829,301, filed Jul. 1, 2010, which claims the benefit of provisional application No. 61/270,097 filed Jul. 2, 2009.

STATEMENT REGARDING FEDERALLY SPONSORED RESEARCH OR DEVELOPMENT

Not applicable.

FIELD OF THE APPLICATION

The application relates generally to a sports related throwing target.

BACKGROUND

The training and development of a baseball pitcher often focuses on methods of improving throwing mechanics and throwing velocity while preventing or minimizing injury. However, traits related to pitch location, the movement on a pitched baseball, and pitch selection from pitch to pitch are often neglected and not included as part of training and development. While good velocity on a pitched baseball may help a pitcher get away with location mistakes in and around the strike zone, the combination of pitch location, pitch selection, changing the speed of the baseball from pitch to pitch, and the movement placed on the baseball from pitch to pitch is desired for long term pitching success—especially at higher levels of competition.

As is commonplace in athletics, individuals frequently offer differing philosophies as to how pitchers should best approach the art of pitching, i.e., how to best pitch to particular batters and how to manage the strike zone via pitch location, pitch selection, and movement on the baseball. A need exists for a training tool that addresses Applicant's own individual philosophy regarding the approach to baseball pitching.

SUMMARY

The present application is directed to a throwing target. The throwing target comprising a baseball strike zone; one or more target zones located in the strike zone and one or more target zones located around the strike zone; and one or more non-target zones located in the strike zone; wherein the total surface area of the target zones located around the strike zone is greater than the total surface area of the target zones located within the strike zone.

The present application is also directed to a method of training the management of a baseball strike zone while performing the act of pitching using the throwing target of this application. The method comprising (A) providing a throwing target comprising (1) a baseball strike zone, (2) one or more target zones located in the strike zone and one or more target zones located around the strike zone; and (3) one or more non-target zones located in the strike zone; wherein the total surface area of the target zones located around the strike zone is greater than the total surface area of the target zones located within the strike zone; and (B) throwing a particular type of pitch toward a particular zone in an attempt to contact a particular zone with the thrown ball.

The present application is also directed to a system for training the management of a baseball strike zone while performing the act of pitching comprising (A) a baseball home plate; (B) a pitchers mound set apart from the home plate; and (C) a pitcher's throwing target comprising (1) a baseball strike zone, (2) one or more target zones in the strike zone and one or more target zones around the strike zone; and (3) one or more non-target zones in the strike zone; wherein the total surface area of the target zones around the strike zone is greater than the total surface area of the target zones within the strike zone, the throwing target being disposed along a target surface; wherein the target surface is situated on an opposing side of the home plate apart from the pitchers mound, the throwing target facing the pitchers mound.

BRIEF DESCRIPTION

Figure 1:
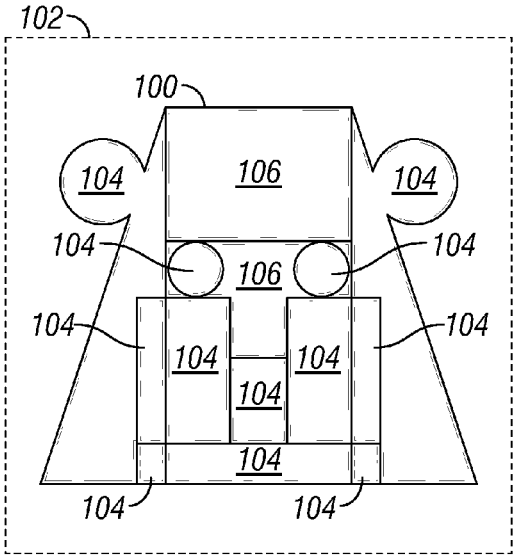
FIG. 1 illustrates a front elevational view of an embodiment of the throwing target of the present application.

In baseball pitching, knowing when to throw, how hard and where to locate a particular pitch, successive pitches, or a series of pitches is vital for getting batters out on a consistent basis. Depending on the count, if a pitcher does not vary the velocity, movement, and location of his/her pitches, a particular batter or the opposing team may better anticipate a particular type of pitch having a certain velocity in a particular location during an at-bat or series of at-bats. Since baseball batters rely heavily on their own timing and/or rhythm when hitting, a batter may better contact or hit a pitched ball when facing a pitcher that does not vary the velocity, movement, and location of pitches effectively. Thus, it is desirable for pitchers to develop those skills that best disrupt a batter's timing and/or rhythm. The present throwing target, system and method provide pitchers a means for developing pitch selection, velocity, movement, and location according to Applicant's own philosophy regarding baseball pitching. Heretofore, such a desirable achievement has not been considered possible, and accordingly, the throwing target, system and method of this application measure up to the dignity of patentability and therefore represent a patentable concept.

Before describing the invention in detail, it is to be understood that the present throwing target, system and method are not limited to particular embodiments. It is also to be understood that the terminology used herein is for the purpose of describing particular embodiments only, and is not intended to be limiting. As used in this specification and the appended claims, the terms "thrower" and "pitcher" may be used interchangeably to refer to an individual throwing, casting, projecting, or propelling a ball toward the throwing target. The terms "training" or to "train" refer to the instruction, development, or education of a pitcher as related to the throwing target of this application. The term "ball" means a spherical projectile including but not necessarily limited to a conventional baseball having seams and laces. Herein, to "throw" means to propel a ball from the throwing hand so as to be airborne. The phrase "pitching sequence" refers to any number of pitches delivered by a pitcher during a single at bat for a particular batter in a game type setting. The terms "movement" and "movement on the ball" and like phrases refer to the directional movement on the baseball from the point of release out from a pitcher's hand toward a throwing target or catcher—the movement on the baseball being determined by the speed and directional rotation of the baseball. The term "velocity" refers to the traveling speed of a pitched baseball. The term "location" or "pitch location" refers to the path of a baseball in space as the baseball travels past the strike zone or home plate—either within or outside of the designated strike zone. The terms "control" and "situational control" refer to a pitcher being able to throw a baseball to a specific location in space in or around a designated strike zone as desired. The game of "baseball" may refer to either baseball or softball, i.e., competitive fast pitch softball. The phrase "home base" includes the commonly used phrases "home plate" or simply the "plate." The phrase "strike zone" refers to a rectangular shaped area as understood by persons of ordinary skill in the game of baseball and as depicted in the figures. The phrase "situational pitching" and like terms refers to game type situations and the pitches thrown in response to a given game type situation. Herein, the term "infielder" refers to one or more of the following position players: pitcher, catcher, first base, second base, third base, and shortstop. With reference to pitching, the phrase "pitch count" refers to the number of pitches thrown by a particular pitcher during a game or practice session. The phrase "batter's count" and "count" refer to the number of balls and strikes a batter has in a particular plate appearance or at-bat as the terms are known by those of ordinary skill in the game of baseball. For example, when a batter first steps into the batter's box for a plate appearance, the batter's count is 0-0. The phrase "ahead in the count" refers to a pitcher possessing the advantage in an at-bat, i.e., when a pitcher has thrown more strikes than balls to a particular batter during a particular at bat. The opposite is true when a batter is "ahead in the count"—meaning more balls than strikes in the batter's count. The phrase "protecting home plate," and like phrases, refer to a batter attempting to avoid a called third strike by swinging at a pitched baseball. The phrases "pitching a strike," "throwing a strike," "strike" and like phrases, refer to a pitcher locating a pitched baseball within the designated strike zone. The phrase "Righty" may refer to either a right handed throwing pitcher or a right handed hitting batter as understood by those of ordinary skill in the game of baseball. Likewise, the phrase "Lefty" may refer to either a left handed throwing pitcher or a left handed hitting batter. The phrase "muscle memory" refers to the process by which an individual's neuromuscular system memorizes motor skills, such as those motor skills related to Applicant's own philosophy regarding the proper approach to pitching. The term "fastball" refers to a pitch typically thrown with backspin, so that the "Magnus Effect," i.e., the force perpendicular to the forward motion on a spinning object moving through a fluid or gas, as that responsible for the curve on a curve ball, creates an upward force on the ball, causing it to fall less rapidly than might be expected. The fastball is typically a pitcher's highest velocity pitch. The phrase "off-speed pitch" refers to pitches other than fastballs. The term "change-up" refers generally to an off-speed pitch thrown with the same arm action as a fastball, but at a lower velocity. The phrase "breaking ball" refers generally to off-speed pitches other than the change-up pitch as the term is typically known in the game of baseball and may be thrown with the same arm action as the fastball. The phrase "delivering a pitch" means throwing a baseball toward a throwing target or toward a catcher during a game or simulation type situation. The term "ball" herein refers to a baseball or a softball. The phrase "irregular shape" refers to a zone of the throwing target having an outer border in a shape other than spherical, rectangular, and regular polygons. The term "batter" refers to the offensive player who takes position in the batter's box to face a pitcher. As understood by those of ordinary skill in the game of baseball, batters may also be referred to as "hitters."

In one aspect, the application provides a pitcher's throwing target configured for use during game type situations or under game speed conditions.

In another aspect, the application provides a portable pitcher's throwing target configured to releasably attach to one or more static structures.

In another aspect, the application provides a portable pitcher's throwing target configured to releasably attach to one or more static or non-static structures.

In another aspect, the application provides a portable throwing target configured to be folded or otherwise rolled up during transport or storage thereof.

In another aspect, the application provides a throwing target having a plurality of target zones.

In another aspect, the application provides a throwing target having a plurality of colored coded target zones.

In another aspect, the application provides a throwing target having a plurality of colored coded non-target zones.

In another aspect, the application provides a throwing target having a plurality of colored coded target zones and non-target zones.

In another aspect, the application provides a throwing target having a plurality of numerically coded target zones.

In another aspect, the application provides a throwing target having a plurality of numerically coded non-target zones.

In another aspect, the application provides a throwing target having a plurality of numerically coded target zones and non-target zones.

In another aspect, the application provides a throwing target having an outer perimeter greater than the intended strike zone.

In another aspect, the application provides a throwing target configured to be used in conjunction with a regulation pitcher's mound and home plate, i.e., major league baseball, college/high school baseball, pony league baseball, little league baseball, as well as international amateur and professional play as desired.

In another aspect, the application provides a throwing target comprising target zones, non-target zones, and a non-zone region surrounding both the target zones and non-target zones.

In another aspect, the application provides a throwing target comprising only target zones and non-target zones.

In another aspect, the application provides a throwing target comprising a plurality of target zones lying in contiguous fashion.

In another aspect, the application provides a throwing target having a first section comprising both target zones and non-target zones, and a second section comprising a non-zone region surrounding the first section, the second section not necessarily being limited to a particular maximum outer perimeter.

In another aspect, the application provides a throwing target disposed along a substrate surface.

In another aspect, the application provides a throwing target configured to deflect a thrown ball back toward the individual throwing the ball at the target.

In another aspect, the application provides a throwing target configured to capture a ball directed at the target upon contacting the throwing target.

In another aspect, the application provides a baseball throwing target configured to develop a pitcher's situational control.

In another aspect, the application provides a baseball throwing target effective for use during simulated game settings or practice sessions.

In another aspect, the application provides a throwing target that may be used either indoors or outdoors.

In another aspect, the application provides a throwing target that may be built to scale as the rules of a particular baseball game may require.

In another aspect, the application provides a throwing target that may be used by individuals to improve throwing aim in competitive sessions similar to throwing darts or playing the game of H-O-R-S-E in basketball.

In another aspect, the application provides a throwing target comprising target zones, non-target zones, and a non-zone region surrounding both the target zones and non-target zones, wherein one or more of the zones of the throwing target may be configured according to the physiological makeup of a human batter.

In another aspect, the application provides a method of training a pitcher to locate pitches within and/or outside of a designated strike zone depending on the particular batter, batter's count, pitch count, game situation, and combinations thereof.

In another aspect, the application provides a throwing target comprising target zones, non-target zones, and a non-zone region surrounding both the target zones and non-target zones, wherein the various zones may be utilized to provoke a particular physical response from a batter depending on the location of a pitch within the various zones of the throwing target.

Discussion of the Throwing Target, System and Method

Figure 2:
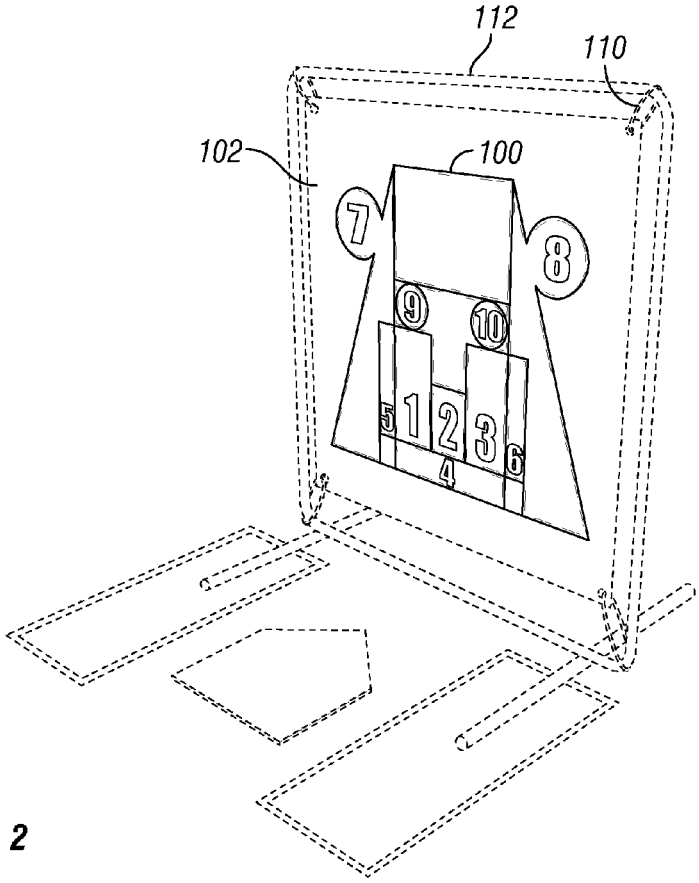
FIG. 2 illustrates a front perspective view of an embodiment of the throwing target attached to a framework and used in conjunction with a home plate and batters box, the throwing target incorporating a number scheme.

To better understand the novelty of the throwing target, system and method of use thereof, reference is hereafter made to the accompanying drawings. With reference to FIG. 1, a simplified throwing target 100 is provided. As shown, the throwing target is suitably disposed along a target surface 102 and includes one or more target zones 104 and one or more non-target zones 106. As illustrated in FIG. 2, the throwing target 100 may be provided upon a target surface 102 comprising a substrate or material having at least a first planar target surface 102. In a suitable embodiment, the target surface 102 comprises a sheet like material whereby one or more releasable fastening means 110 may be implemented to maintain the throwing target 100 in a vertical or upright position during use. Although not necessarily limited to a particular means of attachment, suitable fastening means 110 include for example, string/rope, fabric hook and loop fasteners, tape, adhesives, putty, clamps, wire, linked material, tie-wraps, and combinations thereof.

Depending on the type of fastening means 110 used, the target surface 102 may include a plurality of openings there through, the openings being operationally configured to receive the fastening means 110 for attaching the target surface 102 to a framework 112 as depicted in FIG. 2. In another embodiment, the target surface 102 may include loops attached along its perimeter, the loops being operationally configured to receive the one or more fastening means 110. In still another embodiment, a sheet like target surface 102 may be suspended by fastening only the upper portion of the target surface 102 to a framework 112 or other structure such as netting typically used to form batting tunnels or cages as the terms are understood by persons of ordinary skill in the game of baseball. In another embodiment the target surface 101 may be draped over a framework or the like in a manner effective to suspend the throwing target 100 in an upright position for use. In yet another embodiment, the throwing target 100 may directly receive one or more fastening means 110. It is also contemplated herein that the throwing target 100 and target surface 102 be permanently attached to a framework 112 or other structure. Even still, the throwing target 100 may also be represented on a solid wall or other solid substantially vertically aligned planar surface as desired.

Figure 3:
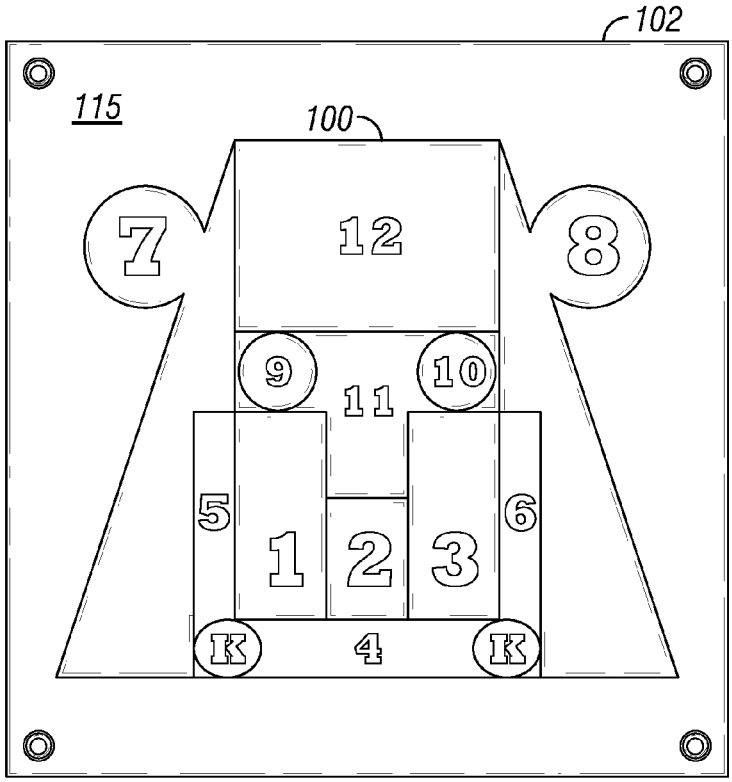
FIG. 3 illustrates a front elevational view of an embodiment of the throwing target on a target surface, the throwing target incorporating a number scheme.

Turning now to FIG. 3, an embodiment of the throwing target 100 is shown having (1) target zones marked 1-10, (2) non-target zones marked 11-12, and (3) "K" target zones as shown. Suitably, the target zones 1-10, non-target zones 11, and K zones are separated by lines or similar dividers. Although the lines or dividers are not necessarily limited to a particular width, a suitable throwing target 100 comprises lines/dividers having a width from about 0.32 cm to about 1.27 cm (0.125 inches up to about 0.5 inches). In a particularly advantageous embodiment, the lines/dividers are about 0.64 cm (about 0.25 inches) in width. In any case, the lines/dividers should comprise a width great enough for a pitcher to perceive and distinguish the various zones easily with reasonable effort irregardless of the color of the lines/dividers.

In one particular embodiment, the throwing target 100 may include a single color across the target zones 1-10 and non-target zones 11-12. In still another embodiment, the throwing target 100 may include multiple colors—one color identifying the target zones and a different color identifying the non-target zones. In yet another embodiment including a non-zone region 115 surrounding target zones 1-10 and non-target zones 11, the throwing target 100 may include multiple colors, a first color identifying the target zones 1-10, a second color identifying the non-target zones 11-12, and a third color identifying the non-zone region 115.

Figure 4:
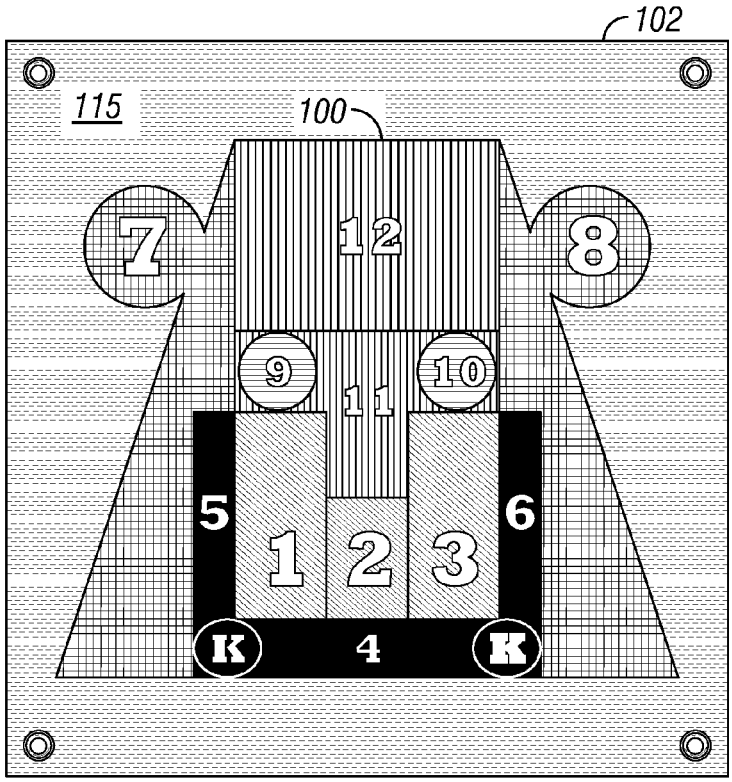
FIG. 4 illustrates a front elevational view of an embodiment of the throwing target on a target surface, the throwing target incorporating a number scheme and color code indicators for the various target zones and non-target zones.

Although any color scheme or color combination may be used, in a particularly advantageous embodiment the throwing target 100 and target surface 102 include one or more colors easily visually distinguishable by the human eye, including in low light environments. With reference to FIG. 4, an exemplary color scheme for the throwing target 100 and target surface 102 is described in Table 1 below.

TABLE 1

| Zone Number | Color |
|---|---|
| Zone 1 | Green |
| Zone 2 | Green |
| Zone 3 | Green |
| Zone 4 | Black |
| Zone 5 | Black |
| Zone 6 | Black |
| Zone 7 | Yellow |
| Zone 8 | Yellow |
| Zone 9 | Blue |
| Zone 10 | Blue |
| Zone 11 | Red |
| Zone 12 | Red |
| - - - | |
| K Zones (two total) | White Circle and White Letter "K" with Black Background |
| - - - | |
| Non-Zone Region 115 | Grey |

Figure 5:
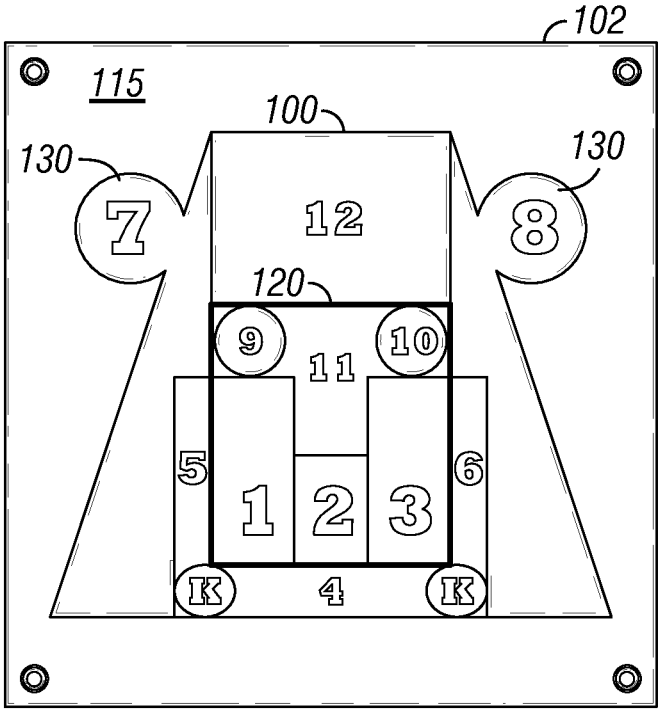
FIG. 5 illustrates a front elevational view of an embodiment of the throwing target on a target surface, the throwing target incorporating a number scheme and highlighting a designated strike zone of the throwing target.

Turning to FIG. 5, a throwing target 100 is provided depicting the orientation of target zones 1-10, K zones, and non-target zones 11-12 in relation to a designated strike zone (depicted as rectangle 120). As shown, both target zones 1, 2, 3, 9 and 10 and non-target zone 11 are located within the designated strike zone 120. Whereas target zones 4, 5, 6, 7, and 8, the K zones, and non-target zone 12 are located outside the designated strike zone 120. In this embodiment, the lower most side of the strike zone 120 is bordered by target zone 4, the left side of the strike zone 120 is bordered by target zone 6, the right side of the strike zone 120 is bordered by target zone 5, and the uppermost side of the strike zone 120 is bordered by non-target zone 12. In a particularly advantageous embodiment as FIG. 5 illustrates, only target zones are located adjacent the right and left sides of the designated strike zone 120.

As further shown in FIG. 5, the lower most border of the throwing target 100 is wider than the upper most border of the throwing target 100. In particular, the outermost target zones (designated as Zones 7 and 8 in FIG. 5), which are located out beyond the designated strike zone 120 draw furthest out from the strike zone 120 near the bottom of the throwing target 100 and taper in toward the strike zone 120 near the top of the throwing target 100.

In a particularly advantageous embodiment, the throwing target 100 is greater in width than it is in height, although the overall size and configuration of the throwing target 100 may be adapted to suit the rules regarding a particular baseball association or rulemaking governing body as it relates to the strike zone. For the purposes of this application, the throwing target 100 is discussed in terms of use with the home base, batters boxes and strike zone according to the rules of Major League Baseball as of the date of this application. For example, as determined by the width of the strike zone according to Major League Baseball, a suitable throwing target 100 has a width ranging from about 73.66 cm up to about 317.5 cm (from about 29.0 inches up to about 125.0 inches). In a particularly advantageous embodiment, the throwing target 100 comprises a width of about 106.7 cm (about 42.0 inches). Although the above dimensions are suitable for adult baseball implementation, the ultimate width of the throwing target 100 may be determined by one or more additional factors beyond just the width of the designated strike zone. For example, a particular batter may stand at a particular spot within the designated batters box including the outer edge of the batter's box or the innermost edge of the batter's box. Likewise, a particular batter may stand in either an open or closed stance whereby the batter's legs are not linearly aligned with the opposing pitcher. Based on such factors, the present throwing target 100 may be operationally configured to include a width (and/or zone configurations) corresponding to the batting stance and/or foot location of a particular batter within the batter's box as desired.

According to Major League Baseball, the front side of home base comprises a designated width. Similarly, the designated strike zone 120 of the throwing target 100 includes a width that corresponds to the width of the front side of the home base being utilized. For example, under the rules of Major League Baseball home base is 43.18 cm (17.0 inches) in width along its front side. Accordingly, the outer boundary of the corresponding strike zone 120 is about 43.18 cm (about 17.0 inches) in width.

Figure 6:
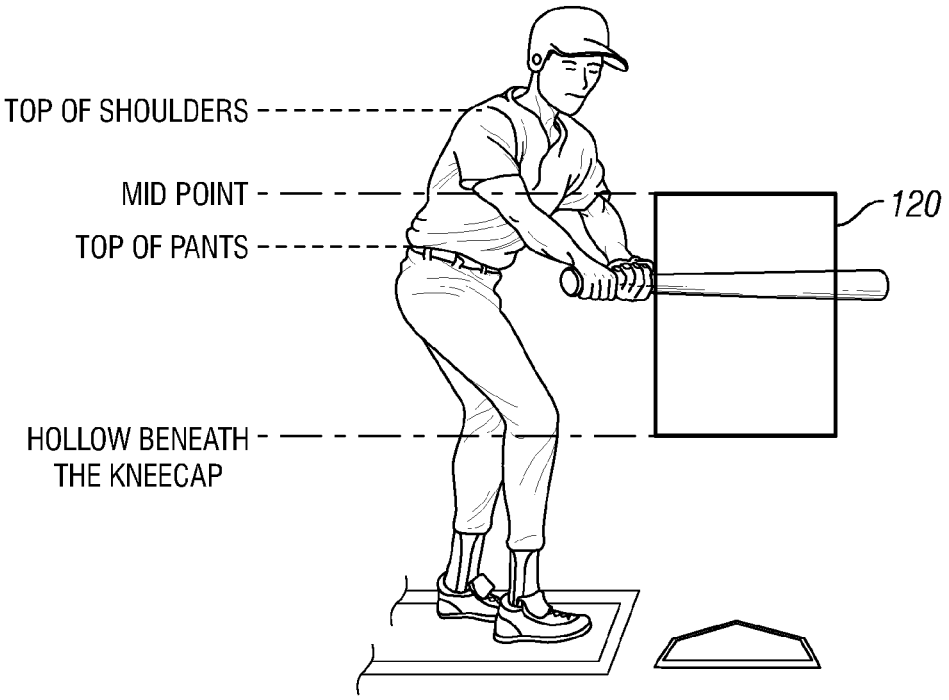
FIG. 6 illustrates a view of an embodiment of an exemplary baseball strike zone as determined by the height, body configuration and batting stance of a particular batter according to the rules of Major League Baseball at the time of filing of this application.

According to the rules of Major League Baseball and others, the height of the designated strike zone 120 may vary depending on the height and/or body configuration and/or batting stance of a particular batter—see FIG. 6. Thus, it is herein contemplated that the designated strike zone 120 of the throwing target 100 may be adjusted in height in order to correlate to (1) a particular designated strike zone, or (2) according to a designated strike zone for particular person(s). Thus, the present strike zone 120 is not limited to a particular height.

In addition, the various target zones and non-target zones may be adjusted in height and/or width to correspond to a designated strike zone 120 or particular batter as necessary. In one exemplary embodiment of operation, the throwing target 100 may include a strike zone 120 having a height corresponding to the strike zone 120 for a particular size batter, e.g., an individual over six feet tall. In another embodiment of operation, the throwing target 100 may include a strike zone 120 having a height corresponding to the strike zone 120 equal to the average height of a certain group of known or anticipated batters. In still another embodiment, an individual may use multiple throwing targets 100 each having a strike zone 120 corresponding to a particular batter or groups of batters.

Also, the bottom most side of the strike zone 120 may be set at variable heights above ground level. In one embodiment, the lower most side of the strike zone 120 may be set at a height equal to the average height of the hollow beneath the kneecap for a certain group of known or anticipated batters (see FIG. 6). In another embodiment, the lower most side of the strike zone 120 may be set at a height for a particular individual batter. In a particularly advantageous embodiment including a throwing target 100 for training pitching to adult male batters, the throwing target 100 suitably comprises a strike zone 120 having a height of about 46.99 cm (about 18.5 inches), wherein the lower most side of the strike zone 120 is situated above ground level at a height of about 43.18 cm (about 17.0 inches).

With reference to individual target zones, each target zone may comprise any number of shapes. For example, as shown in FIG. 5 target zones 1-6 and 12 may be rectangular in shape, although other shapes are contemplated herein. Target zones 9 and 10 may be circular shaped target zones, although other shapes are contemplated herein. For example, target zones 9 and 10 may comprise polygons.

Suitably, a portable target surface 102 with throwing target 100 may be constructed from any material(s) effective to maintain the target surface 102 in a substantially vertical alignment during use, while also being effective to absorb impacts of varying forces at varying speeds from a plurality of projectiles, including thrown baseballs. Suitable portable target surface 102 materials include but are not necessarily limited to metals, plastics, rubbers, woods, synthetic fabric materials, woven fabric materials, non-woven fabric materials, and combinations thereof. In addition, any accompanying framework 112 may be constructed from one or more materials including but not necessarily limited to those materials resistant to chipping, cracking, excessive bending and reshaping as a result of ozone, weathering, heat, moisture, other outside mechanical and chemical influences, as well as the above mentioned impacts from a plurality of projectiles. In one embodiment, a target surface 102 may be constructed from denier nylon materials of various strengths. In a particularly advantageous embodiment, a portable target surface 102 with throwing target 100 is suitably constructed from a canvas fabric ranging from about 67.88 grams up to about 1357 grams per square meter (about 2.0 ounces up to about 40.0 ounces per square yard). Herein, the term "canvas" may refer to a weave fabric material formed from cotton, linen, jute, hemp, polyester, and combinations thereof.

In an embodiment comprising a non-portable throwing target 100, the throwing target 100 is suitably fixed on a substantially flat or planar static surface by means including but not necessarily limited to drawing means, engraving means, silk-screening means, etching means, heat/burning means, and combinations thereof. Suitable drawings means include, but are not necessarily limited to paint, chalk, ink, dye, and combinations thereof. It is also contemplated that individual pieces of material may be placed on a surface to form the boundaries of the various target zones and non-target zones, i.e., formed in a jigsaw puzzle type manner from separate pieces. In still another embodiment, dividers comprising elongated pieces of plastic may be attached to a wall or similar surface to provide the boundaries/divisions of the various target zones and non-target zones. In yet another embodiment, a rope or string like material may be attached to a wall or similar surface to provide the boundaries/divisions between the target zones and non-target zones. It is further contemplated that the present throwing target 100 may include a projection image as desired.

Discussion of Use of the Throwing Target

In operation, the throwing target 100 is suitably effective to train the management of a baseball strike zone. By the term "management," Applicant means that the throwing target 100 is effective to train and develop a pitcher's knowledge and pitching ability regarding the when, where and how to deliver a particular pitch. Regardless of the velocity of a particular pitch, delivering the optimum pitch with optimum movement at the optimum location either in or outside the strike zone suitably increases the probability of getting batters out on a consistent basis.

For the purpose of describing the operation of the throwing target 100, a throwing target 100 as depicted in FIG. 5, including an arrangement of target zones 1-10 in and around a designated strike zone 120, non-target zones 11-12 in and around the strike zone 120, and "K" target zones located outside the strike zone 120 will be referenced here forward. The significance of each target zone and non-target zone, including the size, shape and location of each zone, as well as pitch selection, pitch velocity, and the function each target zone and non-target zone serves in relation to situational pitching is discussed in detail below.

Target Zones 1, 2, 3

The discussion of the throwing target 100 begins with reference to target zones designated 1, 2, and 3, each of which is located at the bottom of the designated strike zone 120. For the purposes of this application, pitches located in target zones 1, 2, and 3 are referred to as quality strikes regardless of the type of pitch delivered.

As shown, zones 1 and 3 are greater in height than zone 2 because it is often easier for a batter to make contact with a pitch high or up in the middle of the strike zone 120 compared to pitches located high in zones 1 and 3. In other words, it is advantageous for pitchers to avoid locating pitches in the strike zone 120 directly above zone 2 in what is herein referred to as non-target zone 11. Target zones 1 and 3 are often referred to as the inner third and/or outer third of home plate by persons of ordinary skill in the game of baseball. Herein, zones 1, 2, and 3 are referred to as "Go Zones."

Suitably, to deliver a pitch through the Go Zones, a ball optimally should be directed along a downward plane, i.e., vertical movement of the ball, from the time the ball leaves a pitcher's hand until the ball crosses home plate or travels through the designated strike zone. Pitches traveling along a downward plane may be more difficult for batters to recognize as to velocity of the pitch than the same pitch traveling along a less downward plane. In other words, if a pitch is thrown flat, i.e., the baseball travels along a plane of lesser downward slope than intended, it may be easier for a batter to recognize the velocity of the pitch thereby increasing the potential of solid contact on the pitched ball. More particularly, flat pitches typically travel along a plane substantially similar to the swing path of a batter's bat often resulting in more solid contact on a pitched ball.

Figure 7:
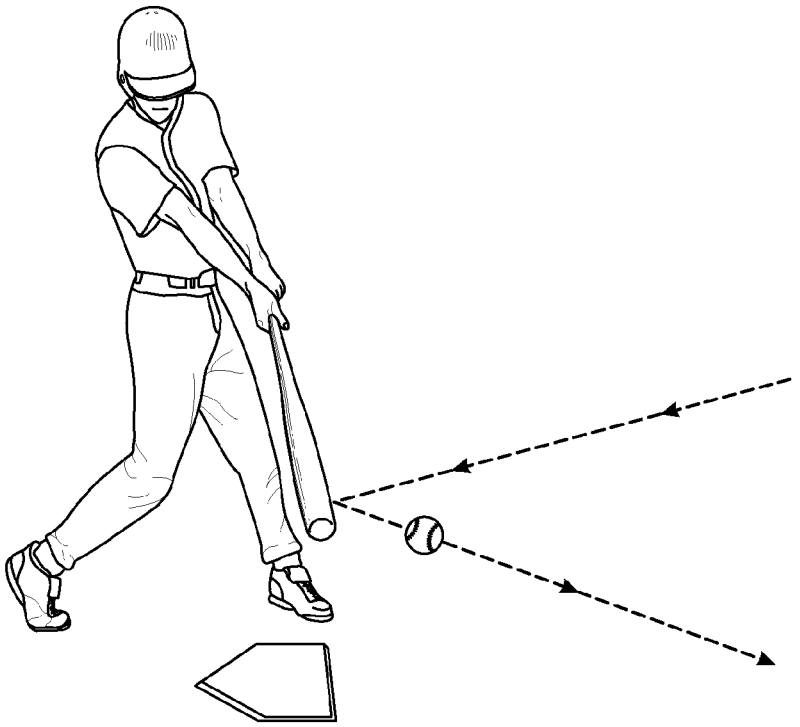
FIG. 7 illustrates a batter producing a ground ball following contact with a pitched baseball.

Another advantage to directing pitches through the Go Zones along a downward plane is the increased chance that a batter may either (1) contact the topside of the baseball producing a ground ball (see FIG. 7), or (2) swing at and miss the baseball entirely. It may also benefit a pitcher to locate pitches in the Go Zones early in the count to increase the opportunity of getting batters out in three or fewer pitches, via (1) a ground ball, (2) called strike, or (3) a swing and a miss. A fastball is typically a good pitch to throw toward the Go Zones early in a count since most pitchers can deliver a fastball with the highest degree of accuracy and precision out of his/her entire pitch selection. Thus, a fastball directed toward the Go Zones may be considered a high percentage pitch.

In most instances, it is desirable to produce ground balls rather than either fly balls or line drives. First, it is highly unlikely that a ground ball will result in a double, triple, or home run. Second, a ground ball single may lead to a future defensive double play by producing another ground ball by an ensuing batter. Third, ground balls may assist in keeping fielders in rhythm, decreasing the chance of errors in the field. Fourth, ground balls and "three up, three down" innings, as the phrase is known in baseball, often change the momentum of a game, shifting the momentum in the pitching team's favor. Fifth, it may also be desirable to produce ground balls when playing a game at high altitude, where fly balls often carry further than normal in the thinner air. Thus, throwing strikes in the Go Zones early in the count not only assists in minimizing pitch counts, but may also minimize the opposing teams slugging percentage and assist in maximizing the fielding percentages of the fielders, especially the infielders.

With further reference to the Go Zones, it is often desirable to target pitches for the Go Zones early in the count, especially during an 0-0 count. Getting ahead in a count 0-1 suitably sets up favorable pitch sequences thereafter. Herein, a favorable pitch sequence means that a pitcher typically has an optimum number of pitch types and more pitch locations for aiming pitches in and around the strike zone 120 at which a batter may be more inclined to attempt to swing in order to contact the pitched ball. On the contrary, when a batter gets ahead in the count, a pitcher typically has fewer types of pitches and fewer pitch locations in and around the strike zone 120 at which at batter may attempt to swing at the pitched ball. In other words, when a pitcher is behind in a count to a batter, the odds of that particular batter seeing a fastball increases. This is due to the fact that a fastball is typically the easiest type of pitch for a pitcher to locate within the strike zone 120, i.e., a high percentage pitch. Unfortunately, a fastball is often times the easiest type of pitch for a batter to contact or hit solidly—even if the pitch is located in the Go Zones.

When a pitcher gets ahead in the count, he/she is considered to be in an offensive position, while the batter is considered to be in a defensive position. The further behind in the count a batter becomes, e.g., counts 0-1, 0-2, 1-2, the more likely a batter is to protect home plate and swing at pitches. In other words, once a pitcher gets ahead in the count 0-1, 0-2, 1-2, a batter is more likely to expand the strike zone 120, i.e., swing at pitches along the border of the strike zone 120 or outside of the strike zone 120 in an attempt to avoid striking out on a called strike three. Thus, the intended effect of a pitcher getting ahead in the count is to force a batter to expand his/her strike zone 120, which may lower the batter's batting average and slugging percentage.

If a pitcher is consistently behind in the count, e.g., 1-0, 2-0, 3-0, 2-1, 3-1, he/she must throw strikes to avoid allowing a batter a "base on balls" or a "walk" as each is commonly used in the game of baseball. Likewise, when a batter is ahead in the count, the batter may be selective and swing only at pitches he/she has a high probability of hitting solid, i.e., a high probability of aligning the swing path of the bat with the plane of the pitched baseball. For example, if a batter is ahead in a count 2-0, he/she may anticipate a fastball being thrown toward either the inner third or outer third of the strike zone. If the pitcher throws a pitch for a strike that the batter isn't expecting, the count is still in the batters favor 2-1. Thus, in a situation requiring a pitcher to throw a strike, the pitcher usually relies on his/her high percentage pitches—the most common pitch being a fastball. Unfortunately, if a batter is expecting a fastball and gets a fastball, especially in non-target zone 11, the greater the probability that the batter will hit the ball solid. Thus, it is desirable that pitchers use the throwing target 100 to become efficient at locating pitches in and around the Go Zones for getting ahead in the count, when behind in the count, and for overall pitching success.

Figure 8:
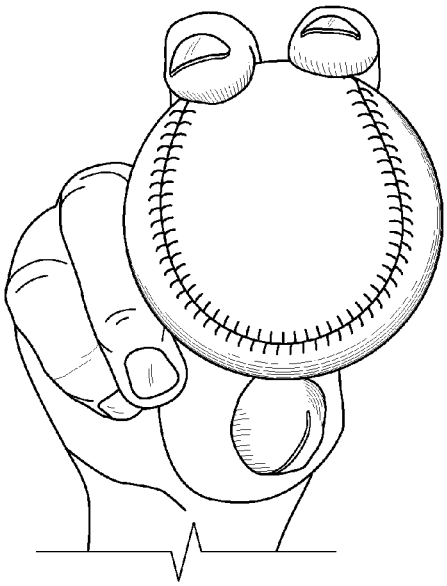
FIG. 8 illustrates an exemplary means for a pitcher to grip a baseball for delivering a two-seam fastball type of pitch.

Not only should pitchers become comfortable and consistent at throwing fastballs in Go Zones 1, 2, and 3, pitchers should also become comfortable and consistent at throwing different types of fastballs in Go Zones 1, 2, and 3 as dictated by the game situation and/or the pitch count. For the purposes of this application, there are two basic types of fastballs: (1) a two-seam fastball, and (2) a four-seam fastball. As shown in the simplified illustration of FIG. 8, a two-seam fastball refers to a pitcher having a two-seam grip on the baseball—suitably with the forefinger and middle finger. The grip on the seams of the baseball suitably determines the type of spin (or rotation) placed on a pitched baseball. To optimize the movement and/or sink on a fastball during flight, the spin placed on the baseball should be more vertical than horizontal. Vertical spin may be referred to herein as "back spin." A fastball having back spin often produces a sinking fastball, while a fastball having side spin typically results in a pitch traveling along a flatter plane. Typically, a two-seam fastball has more movement than a four-seam fastball during flight.

When thrown properly, a two-seam fastball suitably travels (a) down and in toward a right-handed batter if the pitch is delivered from a right-handed pitcher, and (b) down and in toward a left-hander batter if the pitch is delivered from a left-handed pitcher. Obviously, some individual pitchers will naturally have better movement on a two-seam fastball than other individuals.

When a pitcher is behind in a count, it is desirable that he/she throws a two-seam fastball to optimize movement of the pitch. A right handed throwing pitcher should aim to throw two-seam fastballs through target zones 2 and 3, whereas a left handed throwing pitcher should aim to throw two-seam fastballs through target zones 1 and 2. The reason for aiming two-seam fastballs at these particular target zones is because a two-seam fastball characteristically moves to the arm side of the pitcher. For example, when a right-handed throwing pitcher throws a two-seam fastball initially directed toward target zone 2 out of his/her hand, the intended result is for the baseball to actually pass through target zone 3 (referred to as "the inside third of the plate" as stated previously). If a right-handed pitcher throws a two-seam fastball initially directed toward target zone 3, the intended result is for the baseball to pass through the boundary between target zone 3 and target zone 6—often referred to as a "borderline strike" by persons of ordinary skill in the art.

A majority of pitchers will be most effective by throwing two-seam fastballs through target zone 2. As is expected, most batters would prefer to see a straight pitch with no movement through non-target zone 11. Thus, a two-seam fastball gives a pitcher his/her highest probability of creating movement on a fastball, even on a pitch that ends up located in non-target zone 11. In other words, it is desirable for a pitcher to place movement on a fastball in situations where a batter is expecting a fastball while still possessing the ability to throw the pitch for a strike.

In one advanced approach for pitchers, it may be advantageous to locate a two-seam fastball opposite arm side toward the outer third of the strike zone, i.e., toward either target zone 1 or 3. This scenario may be effective for pitchers that have previously developed the ability to locate four-seam fastballs (see FIG. 9) opposite arm side toward either target zone 1 or 3 with high precision. Here, a right handed pitcher suitably directs the two-seamed fastball toward target zone 1, and a left handed pitcher suitably directs the two-seamed fastball toward target zone 3. A two-seam fastball opposite arm side is a suitable pitch (1) when the count is even, or (2) when the pitcher is behind in the count. If thrown with vertical backspin, a pitch that is initially directed toward target zones 1 or 3 may move downward passing across the plate through target zone 4 where the pitch is less likely to be contacted solidly by a batter.

This advanced pitching approach may further be effective in situations where a batter is expecting a fastball since the flight path of the pitch may initially appear to a batter as being directed toward non-target zone 11 or up in target zones 1 or 3, while the pitch itself actually passes through the strike zone toward the bottom of the Go Zones or through target zone 4—creating an illusion to a batter (at the time a batter decides to swing) as being a flat pitch in a non-target zone, when the pitch is actually on a downward plane moving toward the bottom of the Go Zone or toward target zone 4.

As stated above, vertical backspin being placed on the baseball is important for a two-seam fastball to be effective. Until a pitcher can produce downward movement on a two-seam fastball toward the opposite third of the strike zone 120 with consistency while practicing with the throwing target 100, he/she should not attempt to deliver the above described pitch in a game situation. In fact, the above approach is most suitable for those pitchers having better than average movement on their two-seam fastball. When a pitcher is behind in a count, especially counts 2-0, 2-1, 3-1, he/she suitably wants to invite a batter to make contact on the ball, preferably producing a ground ball. Thus, this advanced approach may assist a pitcher in keeping pitch counts low, may limit the number of base on balls or walks given up, and may limit the number and/or types of pitches that a particular batter may see during the course of a game. The fewer amount of pitches and/or types of pitches that a batter sees during an at-bat, the less predictable a pitcher may be when facing the same batter in a succeeding at-bat during a game allowing a pitcher to throw other types of pitches when facing the same batter later in the game.

Figure 9:
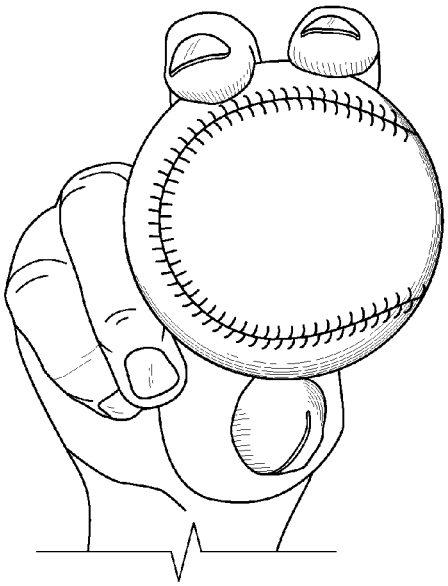
FIG. 9 illustrates an exemplary means for a pitcher to grip a baseball for delivering a four-seam fastball type of pitch.

As shown in the simplified illustration of FIG. 9, an exemplary four-seam fastball includes a pitcher applying a four-seam grip to the baseball using the forefinger and middle finger. As shown, the four-seam fastball includes about a quarter turn of the baseball as compared to the two-seam fastball of FIG. 8. As discussed previously, a four-seam fastball typically travels along a straighter or less downward path than a two-seam fastball, thereby increasing the velocity of the four-seam fastball over the two-seam fastball. With regard to professional play, a four-seam fastball commonly has from about 1.6 kilometer/hour to about 3.2 kilometer/hour (about a 1.0 mph to about a 2.0 mph) increase in velocity over a two-seam fastball for a given pitcher.

A four-seam fastball is commonly thrown when a pitcher desires to deliver a pitch toward a pitcher's opposite arm side of the strike zone 120 or beyond, e.g., a Righty pitching away from a Righty to deliver pitches toward target zones 1, 5, 7 and 9, or a Lefty pitching away from a Lefty to deliver pitches toward target zones 3, 6, 8 and 10. When thrown with proper backspin, a four-seam fastball may be an effective pitch when desiring to pitch to the opposite arm side of the strike zone 120 because a four-seam fastball typically travels along a substantially straight path and is less likely to unintentionally drift off the intended flight path, e.g., drift over the middle of the plate passing through either target zone 2 or non-target zone 11. In addition, a four-seam fastball thrown to the opposite arm side of the strike zone 120, i.e., target zones 1, 3, 9 and 10, may be a high percentage pitch to deliver early in a count to better set up other pitches in and around the various target zones as desired.

To best execute a four-seam fastball in an opposite arm side situation, it is Applicant's position that a pitcher should have good arm extension at release of the baseball from his/her hand to best direct the baseball toward the intended target zone. Once a pitcher establishes the muscle memory for four-seam fastball release point, he/she thereafter may attempt to deliver other pitches from a substantially similar release point as the four-seam fastball and with similar arm extension. It is also Applicant's position that pitchers should strive to have the same delivery for all pitch types, meaning substantially the same or similar windup, tempo/rhythm, arm speed, arm angle, and approach to grasping a ball from the glove prior to delivering a pitch. In a particular advantageous embodiment, a four-seam fastball delivered toward the opposite arm side should be directed toward target zone 10 for left handed throwing pitchers and toward target zone 9 for right handed throwing pitchers.

As a pitcher becomes proficient at locating two and four-seam fastballs in the Go Zones 1-3 and target zones 9 and 10, it may also be beneficial to thereafter develop targeting off-speed pitches in the Go Zones 1-3. Throwing off-speed pitches for strikes is important to a pitcher's success because if a particular pitcher cannot throw off-speed pitches for strikes, batters may eliminate off-speed pitches from those types of pitches he/she is anticipating seeing delivered from a pitcher during a "must strike" situation, i.e., when the batter is ahead in the count. In fact, if a particular pitcher cannot throw an off-speed pitch for a strike, a batter may possibly refrain from swinging at any off-speed pitches altogether.

Generally, a batter's best opportunity for solidly contacting a fastball exists when a pitcher is behind in the count 1-0, 2-0, 3-0, 2-1, and 3-1. If a pitcher gets behind in the count and cannot throw an off-speed pitch for a strike, the pitcher is limited to throwing fastballs in an attempt to avoid walking the batter. The fewer pitch possibilities a batter has to think about during an at bat, the more likely that particular batter will anticipate a particular pitch and its location—possibly increasing the batter's ability to make solid contact with a pitch. Thus, it is valuable for a pitcher to have the ability to throw an off-speed pitch for a strike, at Go Zones 1-3 or otherwise, when behind or even in the count 0-0, 1-1, 2-2, and 3-2.

Figure 10:
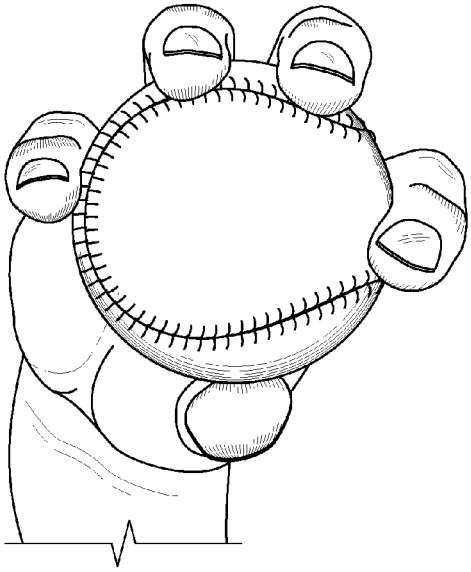
FIG. 10 illustrates an exemplary means for a pitcher to grip a baseball for delivering a change-up type of pitch.
Figure 12:
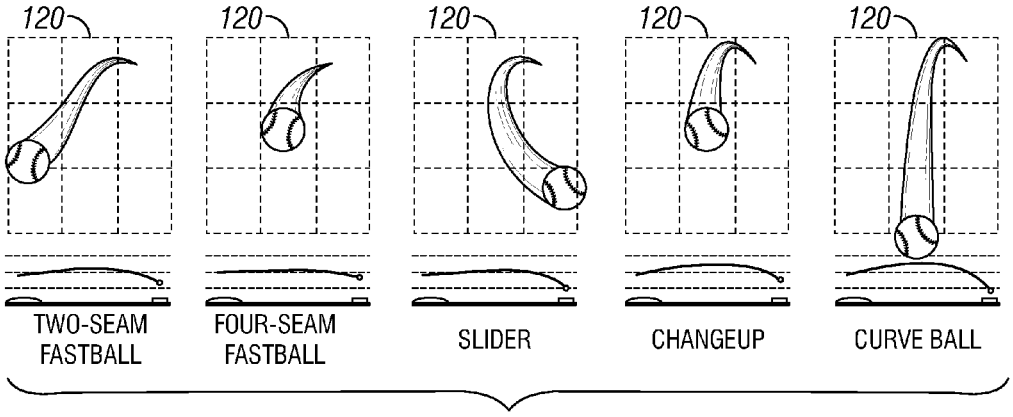
FIG. 12 illustrates the directional flight paths of various pitches as depicted from both a side view of the flight path of the pitched ball and from the catcher's view of the flight path of the pitched ball.

A first example of a suitable off-speed pitch includes the "change-up" as the term is commonly referred to by those of ordinary skill in the game of baseball. To a batter, the change-up pitch appears similar as a fastball at its release point but actually travels much slower than a fastball due to the grip placed on the ball as depicted in the simplified illustration of FIG. 10. The deceptiveness of the change-up pitch is typically due to the fact that a pitcher's arm motion, i.e., arm speed, is substantially similar to the arm speed when delivering a fastball. As shown in FIG. 12, the flight path of a change-up is also substantially similar to the flight path of a four-seam fastball—the intent being to deceive a batter into thinking the change-up pitch is in fact the higher velocity fastball. Thus, the change-up is often a good second type of pitch, after the fastball, to master locating in the Go Zones and Chase Zones. Not only are batters often fooled into thinking a change-up is actually a fastball, a change-up is typically less stressful on a pitcher's arm and shoulder than a curveball or other off-speed types of pitches.

Figure 14:
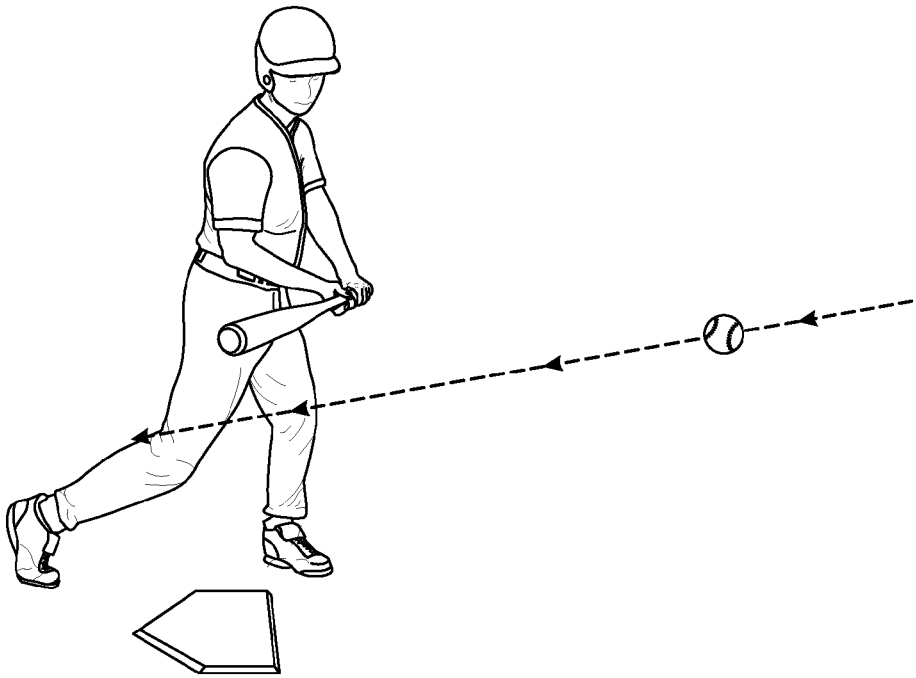
FIG. 14 illustrates a batter that has shifted his/her weight forward onto the front leg while attempting to swing and contact a pitched ball.

A good change-up is intended to disrupt a batter's timing by suitably fooling a batter into prematurely shifting his/her weight forward and/or beginning his/her swing prematurely as depicted in FIG. 14. This is often the case where a pitcher has good velocity on his/her fastball. Herein, the act of disrupting a batter's timing by getting a batter to shift his/her weight out onto his her front leg/stride leg, is referred to as working a batter "back and forth" as the phrase is understood by persons of ordinary skill in the game of baseball.

At the adult or professional level, a pitcher's change-up should have a velocity from about 12.9 kilometer/hour to about 19.3 kilometer/hour (about 8.0 mph to about 12.0 mph) slower than his/her fastball. In a particularly advantageous embodiment, including a pitcher having a fastball reaching about 144.8 kilometer/hour (about 90 mph), a change-up should have a velocity of about 16.1 kilometer/hour (about 10.0 mph) slower than his/her fastball.

With further reference to the change-up pitch, pitchers should suitably attempt to keep the baseball from cutting like other off-speed pitches since a change-up should appear to a batter out of the pitcher's hand as being a fastball, i.e., having backspin on the baseball substantially similar to the backspin of a fastball. Thus, a particularly advantageous change-up pitch is a baseball having backspin promoting vertical downhill movement rather than a flat horizontal movement during delivery. A good visual image for pitchers to use to accomplish good back spin on the baseball includes visualizing a straight line from the middle of a pitcher's rubber through the middle of home plate, thereafter concentrating on taking the throwing hand downward during the throwing motion toward this imaginary line prior to release of the baseball from the throwing hand.

When a pitcher is even or behind in the count a batter is typically expecting a fastball, which is commonly a pitcher's highest percentage pitch for throwing a strike. It is Applicant's position that a pitcher should develop the ability to throw off-speed pitches for strikes in such counts, suitably directing off-speed pitches toward either target zone 2 or 4. It is also Applicant's position that when a batter is expecting a fastball and decides to swing at an off-speed pitch located in either target zones 2 or 4, the change in velocity and height of the off-speed pitch during flight may offset a batter's timing upsetting the possibility of the batter making solid contact with the pitched baseball. Thus, the height of an off-speed pitch, the pitcher's arm-speed, and velocity of the baseball are all possible contributing deceptive factors for a pitcher to consider when throwing off-speed pitches toward target zones 2 and 4 when even or behind in the count.

In addition, off-speed pitches directed toward target zones 2 and 4 may further be advantageous when pitching behind in a count since such pitches are generally afforded room for error if the intended target zone is missed. For example, if an off-speed pitch misses up to about 15.2 cm (about 6.0 inches) to the right or left of target zone 2, the pitch is still located in and around the strike zone at target zones 1, 3, 5 and 6.

Another example of a suitable off-speed pitch to direct toward the Go Zones includes the breaking ball pitch. A breaking ball is a type of pitch that "breaks" or moves during flight along a substantially non-linear path. In order to throw breaking balls successfully, it is important for a pitcher to recognize just how much his/her breaking ball moves or "breaks" during flight so that he/she may (1) realize the proper release point of the ball from his/her hand necessary to direct the pitch toward a particular target zone or non-target zone, and/or (2) continue developing the breaking ball pitch to realize a greater or lesser amount of "break" as desired.

Figure 11:
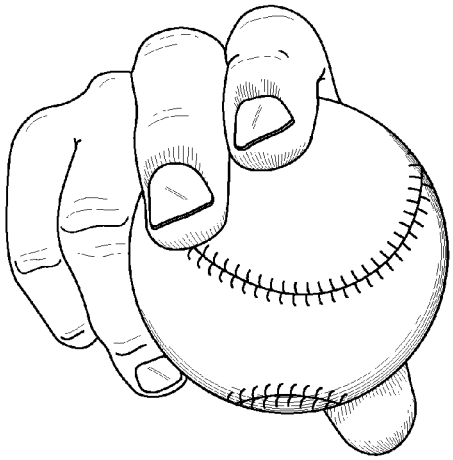
FIG. 11 illustrates an exemplary means for a pitcher to grip a baseball for delivering a curve ball type of pitch.

A first type of breaking ball includes a curve ball pitch, which is thrown by placing topspin on the ball instead of backspin causing the ball to move downward on a curve (see FIG. 12). The amount of topspin placed on the ball may be determined by one or more of the following: (1) the pitcher's grip (see FIG. 11 which illustrates an exemplary curve ball grip), (2) the pitcher's arm strength, and (3) the amount of forward spin the pitcher's hand is capable of applying to the ball upon release. Typically, more topspin amounts to a tighter, shorter break on the ball while less topspin amounts to a slower break on the ball. To be successful, each pitcher should become familiar with the movement of his/her curveball, so as to determine where the pitch needs to be aimed from the point of release to reach a desired target zone or non-target zone.

The following are exemplary scenarios for pitchers making use of the Go Zones when throwing a curveball: (1) locate the curveball at the opposite arm side third of the strike zone when facing an arm side batter, e.g., Righty at target zone 1 when facing a right handed hitting batter, and Lefty at target zone 3 when facing a left handed hitting batter; and (2) locate the curveball at the arm side third of the strike zone when facing an opposite arm side batter, e.g., Righty at target zone 3 when facing a left handed hitting batter, and Lefty at target zone 1 when facing a right handed hitting batter—often referred to as a "backdoor" curveball by persons of ordinary skill in the game of baseball. The backdoor curveball may be made even more effective during a particular at bat if a pitcher can also locate a fastball at either "Purpose Zone" 7 or 8 opposite the batter. For example, delivering an up and away fastball followed by delivering a backdoor curveball at the outer third Go Zone may be effective for freezing a batter that may initially recognize the backdoor curveball as another fastball up and away at release and throughout roughly the first half of the balls fight toward the plate. A well thrown backdoor curveball makes deciphering the pitch type more difficult for batters since both a fastball up and away and a backdoor curveball have similar flight paths out of a pitcher's hand. As a result, batters cannot necessarily eliminate the type of pitch he/she may be seeing at the time a decision is made to swing or not to swing the bat.

A backdoor curveball in the Go Zones may be effective in both early and late counts. A pitcher may also deliver a curveball toward target zone 2 when behind in the count since such counts are traditionally fastball counts. Furthermore, a curveball may be an effective pitch to throw when ahead in the count and facing an arm side batter.

Figure 13:
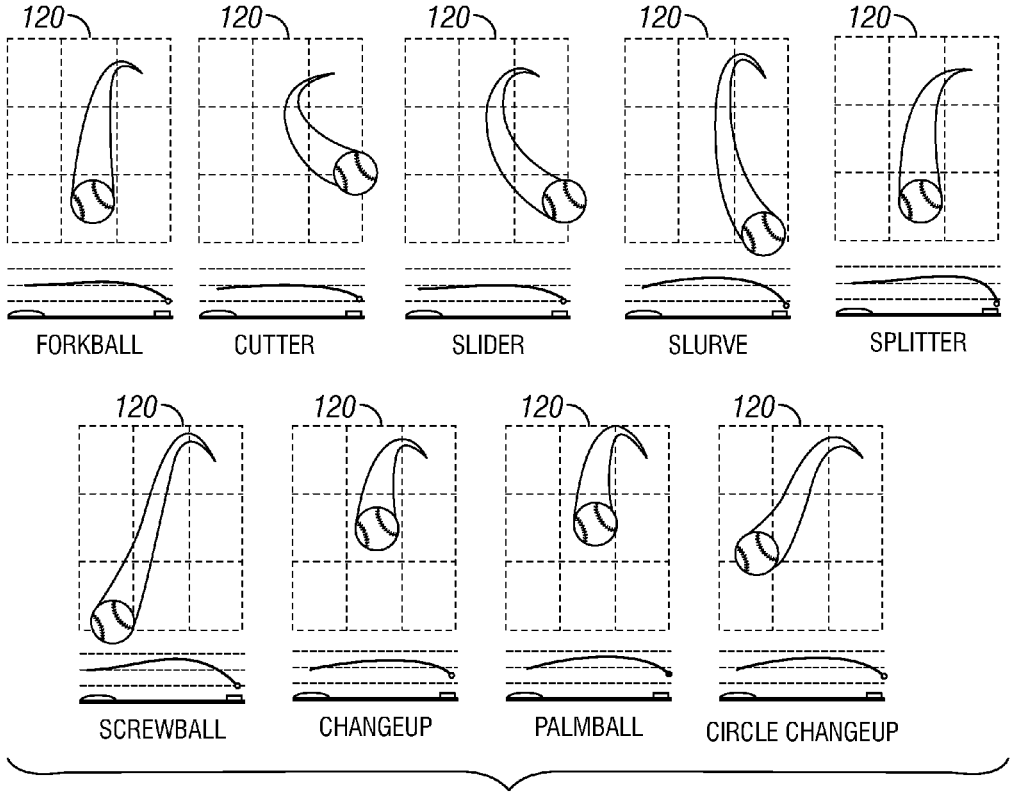
FIG. 13 illustrates the directional flight paths of various breaking ball pitches from both a side view of the flight path of the pitched ball and from the catcher's view of the flight path of the pitched ball.

For purposes of this application, a curveball should be thrown by pulling down on the top of the baseball just prior to release of the baseball, i.e., along a top seam with pressure from the middle finger while pushing upward on the baseball with the thumb, which is suitably placed along a bottom seam, creating topspin for optimum vertical movement of the baseball. Proper topspin helps to keep the thrown baseball off the batter's swing plane while targeting the Go Zones. Other types of breaking ball pitches include, but are not necessarily limited to the slider, the sinker, the cut fastball, the forkball, the split-finger changeup, the screwball, the spitball, the knuckleball, the slurve pitch, the eephus pitch as the term is understood by those of ordinary skill in the art of baseball, and combinations thereof. Exemplary illustrations of the directional flight paths of various breaking ball pitches are shown in FIG. 13.

Target Zone 4

Figure 15:
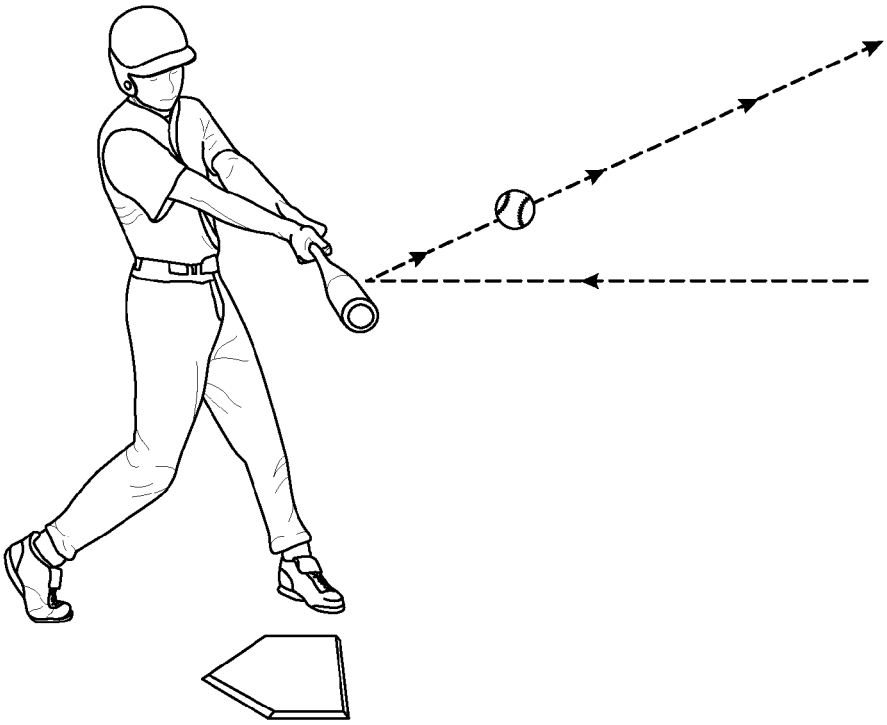
FIG. 15 illustrates a batter aligning his/her bat swing path on the plane of the pitched baseball and making contact with the pitched ball.

The discussion now turns to another desirable target zone for locating pitches—target zone 4. Target zone 4, referred to as the "Chase Zone," is located directly below the Go Zones. To persons of ordinary skill in the game of baseball, pitches located at target zone 4 are often referred to as "missing low" since target zone 4 borders the bottom of the designated strike zone 120. It is Applicant's position that batters may have difficulty making solid contact on pitches directed toward target zone 4, suitably increasing the chance of getting batters out. Moreover, fastballs directed toward target zone 4 suitably travel along a downward plane often making it difficult for a batter to perceive the velocity of the pitch. If a pitcher misses high and locates a pitch above the Go Zones, a batter may be more likely to align his/her swing path on the plane of the pitched baseball increasing the chance to make solid contact with the ball as exemplified in FIG. 15. Thus, it is Applicant's position that pitches aimed for the Go Zones should miss low in target zone 4 rather than miss high above the Go Zones because pitches directed toward target zone 4 are effective for producing (1) ground balls (FIG. 7), and (2) swing and misses. In addition, since target zone 4 borders the strike zone 120 it is not uncommon for pitches passing through target zone 4 to be called strikes by the plate umpire.

As such, the present throwing target 100 is operationally configured to aid pitchers in developing pitching skills necessary to avoiding missing high above the Go Zones. In other words, the present throwing target 100 is operationally configured to aid pitchers in developing pitching skills necessary to avoiding locating pitches within the non-target zones 11 and 12. Thus, in one particularly advantageous embodiment, it is desirable to color code non-target zones 11 and 12 a color(s) signifying danger to the user of the throwing target 100. Although any color or combination of colors may be used to represent target zones 11 and 12, one suitable color is red and shades thereof operationally configured to serve as an indicator of locations considered dangerous for spotting pitches. It is Applicant's position that pitches passing through target zones 11 and 12 are often flatter pitches closer to a batter's eyes and easier to determine the velocity and spin of the pitch—often resulting in a batter making solid contact (see FIG. 15) and driving the baseball into the gaps, or even over the playing field fence resulting in a home run. Thus, it is desirable for pitchers to miss low below the strike zone 120 in target zone 4 rather than miss high above the strike zone 120 or within the strike zone 120 above the Go Zones target zones 11 and 12.

One suitable pitch for targeting at the Chase Zone includes a two-seam fastball. In one implementation, a two-seam fastball may be directed toward the bottom of the Go Zones ending up passing through the Chase Zone. The late movement of the two-seam fastball is effective for the pitch to dive below the Go Zones into the Chase Zone after a batter has already committed to swing at the pitch. A two-seam fastball directed toward the bottom of the Go Zones and passing through the Chase Zone may be a suitable pitch choice under various game type situations, including, but not necessarily limited to (1) a double play situation, i.e., (a) runner on first base, (b) runners on first and second bases, (c) runners on first, second and third base with less than two outs, (2) throwing fastball in either a fastball count or must strike situation, and (3) less than two outs with runner on third base and infield position players playing in on the grass as understood by those of ordinary skill in the game of baseball.

Target zone 4 may also be a suitable location to direct a first pitch to a batter during an at-bat. Pitching aggressiveness early in a count and locating pitches below the strike zone 120 may be effective for producing one pitch outs via an infield ground ball—especially when facing batters that have a tendency to swing at the first pitch during an at-bat. To persons of ordinary skill in the game of baseball, the late movement of the two-seam fastball may also be referred to as a "sinking fastball"—see FIG. 10. Again, a two-seam fastball may be effective at keeping pitch counts low during a game, while producing ground balls leading to more double play opportunities while also keeping the defensive players sharp by increasing their opportunity to make defensive plays during a game.

Target zone 4 may also be an effective location for locating curveballs and change-ups regardless of the count on a batter. One reason for locating off-speed pitches in target zone 4 is that typically any pitch directed toward target zone 4 appears as a strike to a batter at some point during the flight of the baseball. Thus, by effectively and consistently spotting off-speed pitches in target zone 4 pitchers may avoid "hanging" off-speed pitches up in the strike zone or above the strike zone as understood by persons of ordinary skill in baseball. Hanging pitches often times have little movement, i.e., a flat pitch, the velocity and rotation of which may be easier for a batter to recognize during mid-flight of the pitch increasing the chance of a batter making solid contact on the baseball.

Target zone 4 may also be an effective indicator for users of the throwing target 100 with regard to the amount of "tilt" placed on a thrown curveball. Generally, a curveball that passes through target zone 4 has good tilt. Herein, the term "tilt" refers to the topspin or vertical movement of the baseball as the baseball passes through the strike zone 120. To a batter, a curveball with good tilt often appears as a pitch up in the strike zone 120, e.g., non-target zone 11. However, due to the tilt of the ball, the ball suitably drops passing through target zone 4. On the other hand, a curveball with no tilt or very little tilt, i.e., a flat pitch, typically travels side to side rather than high to low, and often times moves offline away from the strike zone 120 early enough during flight that a batter may recognize the pitch as being directed outside past the strike zone 120. In such situation, a batter may choose not to swing the bat (often referred to as "taking" the pitch, or "laying off" the pitch. Alternatively, a batter may swing at the pitch possibly getting his/her bat on the plane of the ball's flight path. Like a sinking fastball, a curveball located in the Chase Zone suitably produces a ground ball, a called strike, or a swing and a miss. A curveball aimed at the Chase Zone may be used while the pitcher is ahead in the count and the batter may be forced to expand the types of pitches and pitch locations at which he/she is willing to swing including pitches outside of the strike zone 120.

Target Zones 5 and 6

The target zones marked 5 and 6 located adjacent target zones 1 and 3 and bordering the strike zone 120 may also be referred to as "Chase Zones" since pitches directed toward target zones 5 and 6 may be pitches effective for inducing batters to chase after by swinging. Target zones 5 and 6 are also desirable areas to locate pitches when a batter is behind in the count, the object being to produce called strikes, including called third strikes where the batter is "caught looking" at the pitch as understood by persons of ordinary skill in the art of baseball. Suitably, a pitcher should locate pitches in target zones 5 and 6 in situations when a batter is likely to be aggressive, i.e., when a batter has an increased propensity to swing at a pitch. Suitable pitch counts in which to direct pitches toward target zones 5 and 6 include, but are not necessarily limited to counts 0-2 or 1-2. As an individual develops greater command of his/her pitches through use of the throwing target 100, pitches may be directed toward target zones 5 and 6 in counts other than 0-2 or 1-2.

As depicted in the various Figures, target zones 5 and 6 are located along the outer borders of the right and left sides of the strike zone 120 from about the bottom of the strike zone 120 up to a height about equal to the lower two-thirds of the strike zone 120. Although the width of target zones 5 and 6 (and zone 4) may vary, a suitable width may be about equal to the outer diameter of the ball being pitched. For example, a Major League Baseball, as manufactured by Rawlings Sporting Goods Company, Inc., has an outer diameter from about 7.3 cm to about 7.5 cm (from about 2.86 inches to about 2.96 inches). So, in one simplified embodiment for baseball purposes, zones 4, 5, and 6 may each include a width up to about 10.2 cm (about 4.00 inches).

A pitch located in target zones 5 or 6 is often referred as a "borderline strike" as the phrase is known to those of ordinary skill in the game of baseball. Pitches passing through target zones 5 and 6 are located close enough to the strike zone 120 to possibly be called strikes by umpires. As such, batters are often induced to swing at such pitches during two strike counts in an attempt to protect against striking out. Likewise, pitches located in either target zone 5 or 6 are not typically pitches contacted solidly by batters.

It should also be noted that a home plate umpire may be more likely to call pitches located in target zones 5 and 6 for strikes when a pitcher is consistently locating pitches within the Go Zones 1, 2 and 3. Whereas, the same umpire may be less likely to call strikes for pitches thrown through target zones 5 and 6 if a pitcher is consistently missing the strike zone 120 with pitches only to later hit either target zone 5 or 6. It is Applicant's position that home plate umpires often have a rhythm of their own as to calling balls and strikes, and umpires are more likely to call borderline strikes on pitches passing through target zones 5 and 6 for those pitchers that have consistently located pitches within the Go Zones during a game.

Typically, batters have to make a decision whether to swing or not to swing at a given pitch in less than a quarter of a second from the point of release of the baseball from a pitcher's hand. When a batter is behind in a count, e.g., counts 0-2, 1-2, he/she cannot necessarily eliminate any one type of pitch or an area of the strike zone 120 as a possible pitch location. As opposed to situations when batters are ahead in a count and looking to swing only at pitches down the middle of the strike zone 120, a batter behind in a count typically has to make a split second decision whether or not to swing at a borderline strike in target zones 4, 5, 6, and K zones—often forcing a batter to swing at a wider variety of pitches and at a greater number of pitch locations. For example, when a batter is behind in the count with two strikes he/she has to protect about 7.6 cm (about 3.0 inches) beyond either side of the plate, i.e., the strike zone 120 plus target zones 5 and 6 in width, with the expectation of seeing any one of the pitcher's various pitches. As a result, the present throwing target 100 displaying target zones 4, 5, 6, and the K zones is operationally configured to train pitchers to get ahead in counts in order to maximize his/her successive pitch options.

Turning now to the mental aspect of pitching with respect to the Chase Zones, it may be suitable under certain situations for a pitcher to use a batter's aggression against himself/herself. Therefore, pitchers may expand pitch location into the Chase Zones in response to those batters having a propensity to swing at pitches located outside of the designated strike zone during a particular at bat. As stated above, pitchers should suitably make use of the Chase Zones when ahead in the count, rather than behind in the count. Targeting the Chase Zones when behind in counts may result possibly walking batter(s), i.e., base on balls, which may add to a pitcher's total pitch count and fatigue during a game. High pitch counts and base on balls may further result in the defensive fielders losing concentration over the course of a game, which may result in fielding errors when a ball is eventually hit into play. High pitch counts may also result in a pitcher being replaced by a relief pitcher earlier in a game than normally desired. Typically, starting pitchers are more effective pitchers than relief pitchers, so it is important for starting pitchers to develop accuracy and precision via use of the throwing target 100 to effectively pitch as many innings during a particular game as possible.

Other undesired results of giving up base on balls to batters include (1) pitchers having to go deep into pitch counts, e.g., 2-2, 3-2, and (2) pitchers not being able to maintain a throwing/pitching rhythm from pitch to pitch, as is often the case when a pitcher has to draw his/her attention away from a particular batter toward a base-runner(s). The more base-runners a pitcher has to focus on, the less focus a pitcher typically places on the present batter. As discussed above, in order to use the Chase Zones effectively a pitcher should be ahead in the count, which is accomplished by first pitching effectively toward the Go Zones.

During a game type situation, it is also valuable if the hind catcher, coach or person calling the pitches is aware of and mentally makes use of a similarly oriented target zone/non-target zone configuration as that of the pitcher. For example, a catcher should know the location of the pitcher's Chase Zones when attempting to produce a borderline strike. Thus, a catcher setting up for a Chase Zone pitch should set up behind the plate by positioning his/her mitt at the spot within the Chase Zone at which he/she desires to receive the pitch. For example, during an 0-2 or 1-2 count, if a catcher calls for a pitch in a Chase Zone, but instead sets up on the outer half of the strike zone 120, the home plate umpire may be less likely to call a strike than when a catcher sets up the mitt in the actual Chase Zone. This is because a catcher will most likely have to direct his/her mitt outward toward the Chase Zone away from the mitt's initial set up position in order to catch the ball. Such outward mitt movement often creates an illusion to a home plate umpire who may interpret the pitch as being located farther outside off the strike zone 120 than the pitch's actual location.

If a pitcher misses either target 5 or 6, it is desirable to miss along the outer edges of these targets—a similar strategy as missing low when targeting zone 4. Pitches that miss either target 5 or 6 passing instead through the Go Zones may have an increased probability of being contacted solidly by a batter. In addition, pitches directed toward the Chase Zones may be thrown with substantially less velocity than normal to purposely show the batter a different velocity of pitch, possibly assisting in disrupting a particular batter's timing.

One suitable scenario for using target zones 5 and 6 includes, but is not necessarily limited to throwing a fastball down and away opposite arm side in the appropriate Chase Zone at about seventy-five (75) percent normal velocity. Such velocity may make the next fastball appear to be traveling at a much faster rate than its actual velocity since a batter's timing may have been compromised from viewing the previous fastball thrown at about seventy-five percent (75%) of normal velocity. In addition, it may be desirable to locate pitches off the strike zone 120 between the batter and either target zone 5 or 6, which is often referred to as "throwing inside" by persons of ordinary skill in the game of baseball.

By throwing inside on a batter during counts 1-2 and 0-2, a pitcher may successfully exploit the outer third of the strike zone 120 on the following pitch or future a pitch during the same or future at-bat. Throwing inside is discussed below in greater detail.

Developing proper pitch selection is another desirable attribute for pitchers when targeting the Chase Zones of the present throwing target 100. For instance, both the two and four-seam fastball may be used as Chase Zone pitches depending on the count and/or game situation. In one example, a four-seam fastball may be a suitable pitch to deliver when attempting to locate a pitch opposite arm side, i.e., Righty away from Righty; Lefty away from Lefty. When attempting to locate a pitch arm side, i.e., Righty away from Lefty; Lefty away from Righty, a two-seam fastball may be a suitable fastball to deliver. With regard to the former, a pitcher should deliver an opposite arm side pitch along a substantially straight flight path. Conversely, a pitcher should deliver an arm side pitch in a manner effective for the baseball to move toward the inside edge of the strike zone 120 or inside of the strike zone 120 toward a batter.

Situations also exist for off-speed pitches to be targeted for the Chase Zones 4, 5, and 6. Suitably, an off-speed pitch is directed out from the pitcher's hand along a flight path toward the strike zone 120 or along a path deemed hittable by a batter. If executed properly the off-speed pitch should appear hittable to the batter long enough to entice the batter to commit to swinging at the pitch, at which time the pitch is directed toward target zone 4, 5 or 6 as desired. On the other hand, if the same pitch appears to be moving toward a Chase Zone early after release, a batter may hold back and not swing. Ineffective off-speed pitches typically occur when thrown flat or when the pitch lacks depth, which means the baseball remains on substantially the same plane throughout the flight of the pitch. The present target zone 100 is operationally configured to train pitchers to become effective at targeting the Chase Zones with off-speed pitches. Pitchers having command of their off-speed pitches may also have success throwing off-speed pitches early in a count, e.g., counts 1-0, 0-1, and 1-1.

Target Zones 7 and 8

To develop throwing inside on batters the instant throwing target 100 includes target zones 7 and 8. Referred to as "Purpose Zones," target zones 7 and 8 are the largest target zones on the throwing target 100. As FIG. 5 illustrates, Purpose Zones 7 and 8 are located outside of the strike zone 120 along the entire height of the throwing target 100. In particular, target zone 7 is located between the strike zone 120 and left handed hitting batters, and target zone 8 is located between the strike zone 120 and right handed hitting batters. By effectively throwing one or more pitches toward a batter in the corresponding Purpose Zone, a pitcher may intimidate the batter causing the batter to be less likely to step in, or dive in toward the strike zone 120 in an attempt to swing at outside pitches crossing the opposite side of the strike zone 120.

With further reference to FIG. 5, the Purpose Zones 7 and 8 may be irregular shaped zones comprising protruding sections 130 near the top of each zone, each protruding section 130 jutting out away from non-target zone 12 as shown. Although not necessarily limited to a particular shape, the protruding sections 130 suitably jut out in a manner effective to assist individuals in locating pitches toward a batter's mid-section or higher. In a particularly advantageous embodiment, the protruding sections 130 should jut out at a height about equal to the sternum region of a batter. Thus, the throwing target 100 may be built to scale as desired.

As shown, the protruding sections 130 may be substantially circular or oval in form. In another embodiment, the protruding sections 130 may be rectangular or otherwise multi-sided as desired. Although any color or color combination may be used to define each of the Purpose Zones, a suitable color includes one or more shades of yellow. A yellow type color suitably serves as a reminder to the user of the throwing target 100 that batters need to observe caution when facing pitches located in the Purpose Zones, especially since batters may be hit by pitches located in zones 7 and 8.

Figure 16:
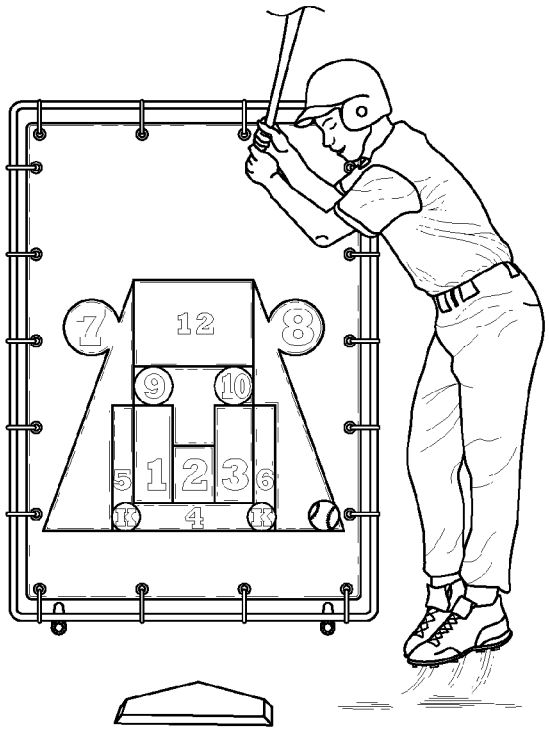
FIG. 16 illustrates a pitch located at a low point within a Purpose Zone of the throwing target and a batter moving his/her feet directionally away from the pitched ball.
Figure 17:
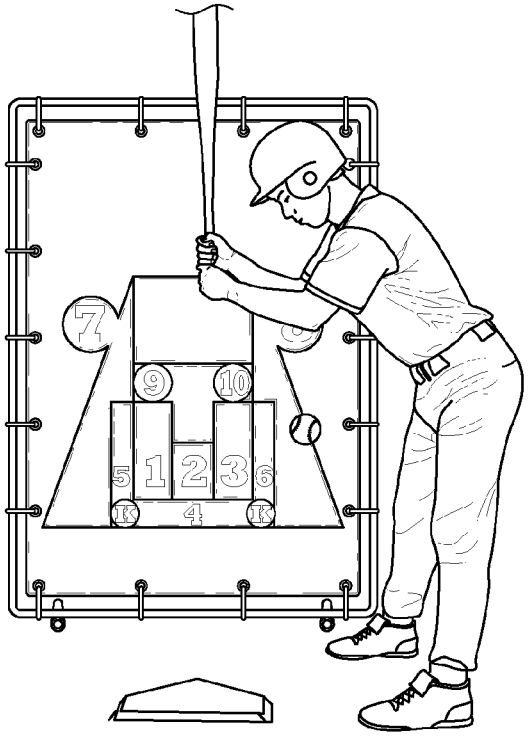
FIG. 17 illustrates a pitch located at about halfway up within a Purpose Zone of the throwing target and a batter moving his/her waist area directionally away from the pitched ball.
Figure 18:
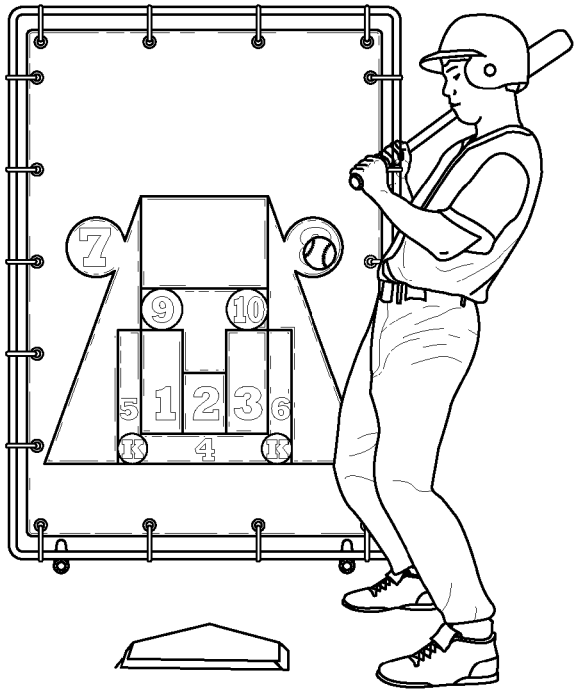
FIG. 18 illustrates a pitch located at a high point within a Purpose Zone of the throwing target and a batter moving his/her upper body directionally away from the pitched ball.

Generally, pitchers have an advantage over batters in relation to pitches located on the outer half of the strike zone 120 opposite or away from batters. Conversely, batters generally have an advantage over pitchers with regard to pitches located on the inner half of the strike zone 120 toward batters. By developing the ability to deliver pitches in the Purpose Zones, a pitcher may successfully unsettle a batter in a game type situation especially since most batters desire to be comfortable while standing in the batter's box during an at-bat. If a batter recognizes that a pitcher is unwilling to throw inside within the Purpose Zones, the batter may be more likely to dive in toward the strike zone 120 allowing the batter to reach pitches located on the outer half of the strike zone 120 without fearing being hit by a pitch. In such a scenario, a batter may be able to mentally eliminate any pitches being thrown within the corresponding region marked as a Purpose Zone. The more pitches and pitch locations that a batter can mentally eliminate from his/her mind the greater the probability that a batter will see a pitch he or she is anticipating, which may increase the batter's timing and chance of make solid contact on the pitch. As shown in FIGS. 16-18, the object of purpose pitches directed toward target zones 7 and 8 is to move a batter's feet, legs, hips, mid-section, torso, shoulder, head, and combinations thereof away from the strike zone 120 in an attempt to create distance between the batter and the strike zone 120. Once a batter has faced a purpose pitch in either target zone 7 and 8, the batter may become hesitant or less likely to step in, or dive in, toward the strike zone 120 in an attempt to achieve plate coverage as the phrase is known to those of ordinary skill in the game of baseball. In addition, hind catchers should recognize target zones 7 and 8 and be able to set up inside off the plate prior to pitch delivery in order to assist a pitcher in visualizing the desired Purpose Zone.

As FIG. 5 illustrates, target zones 7 and 8 suitably taper out gradually from their uppermost edges to their bottommost edges out widening the throwing target 100 top to bottom. In other words, the outer edges of target zones 7 and 8 draw closer to the batter's box and batter toward the bottom of the throwing target 100. The gradual widening of the Purpose Zones reflect the further inside that a pitch is to be located toward a batter depending on the location of the pitch. For example, to move a batter's feet, purpose pitches should suitably be located below the waistline inside to a batter and off the strike zone. Generally, the higher the purpose pitch, feet to mid-section, the closer to home plate the pitch should be located. FIGS. 16-18 illustrate typical physical reactions by a right handed hitting batter to pitches located at various heights within target zone 8.

Batters typically do not attempt to avoid being hit by a pitch located from about the mid-section down, unless the pitch is directed far enough inside toward the batter near the outer edge of the Purpose Zones. However, if a pitcher redirects the same pitch higher in the Purpose Zone, from about the batter's waistline up to about the elbows of the batter, the batter is more likely to attempt to avoid being hit by the pitch typically falling back or moving back off from home plate.

Suitably, for a pitcher to be effective high in target zones 7 and 8, a purpose pitch should be located from about the batter's chest or sternum down, i.e., from the "letters" down or chest down as understood by persons of ordinary skill in the game of baseball. In a particularly advantageous embodiment as shown in FIG. 18, a pitcher should use the protruding sections 130 of the throwing target 100 as regions to aim for when practicing delivering this type of purpose pitch. For reasons of sportsmanship and safety, a pitcher should attempt to direct purpose pitches at least below a batter's shoulders to avoid throwing at a batter's head. Proper use of the Purpose Zones may lead to batters being susceptible to (1) successive pitches located (1) down and/or away toward the outer half of the strike zone 120, and (2) breaking ball pitches initially directed toward the Purpose Zone in toward a batter but breaks passing through the strike zone.

In one implementation, the protruding sections 130 may be employed by delivering a fastball toward a protruding section 130 in on a batter followed by delivering an off-speed pitch within the strike zone 120. In another implementation, a pitcher may locate a fastball at a protruding section 130 in on a batter followed by delivering a change-up toward the outer half of the strike zone 120 within the Go Zones or target zone 4. Likewise, by locating a fastball at either of the protruding sections 130, a pitcher may thereafter get away with throwing a subsequent mistake pitch, i.e., a flat curveball down the middle of the strike zone, due to the fact that the batter is still seeing two pitches coming out of the same slot, i.e., the initial flight path from the pitcher's hand to a point where the curveball begins to break down toward the strike zone 120. If a pitcher follows up a purpose pitch in either zone 7 or 8 with a good curveball, the curveball may be more difficult to hit than had a pitcher not first thrown the purpose pitch.

It is Applicant's position that pitchers should throw Purpose Zone pitches in an attempt to keep batters from recognizing subsequent off-speed pitches, e.g., a curveball that initially appears to a batter as a fastball due to the location or slot of the baseball out from the pitcher's hand. For instance, if a left-handed throwing pitcher locates a fastball at target zone 8 when facing a right-handed hitting batter, it may be more difficult for the batter to adjust to a change-up or other subsequent off-speed pitch located at target zone 1—and vice versa (target zones 7 and 3 when a right-handed throwing pitcher is facing a left handed hitting batter). For the purpose of this application, the opposite of a hard inside fastball on a batter is an off-speed pitch away from a batter.

The act of throwing a particular pitch toward a particular zone to improve the effectiveness of a subsequent pitch may be referred to as "setting a batter up," whereby the purpose pitch is intended to improve the effectiveness of a particular subsequent pitch in relation to the previous purpose pitch. By practicing changing pitch velocity and location while using the throwing target 100, a pitcher is more likely to develop set up pitches effective to disrupt a batter's timing during a game type at-bat. Generally, the most effective pitch counts for throwing purpose pitches in target zones 7 and 8 include, but are not necessarily limited to counts 0-1, 0-2, and 1-2.

It is further contemplated that purpose pitches may be utilized early in a pitch count. If a particular batter during a previous at-bat (1) hit the baseball solidly to the opposite field, (2) pulled an outside pitch, or (3) has a tendency to step/stride inward or dive in toward the strike zone 120, a purpose pitch may be effective during counts 0-0 and 1-0 to send a message to the batter that he/she had better not continue to stride inward toward the strike zone 120. Conversely, a pitcher should avoid throwing a very aggressive purpose pitch to a weak batter, e.g., a batter hitting in the batting order in positions 7, 8, or 9. The thought here is to avoid putting weak batters on base via a hit-by-pitch or base on balls since batters hitting near the bottom of the batting order are generally easier to get out via a put out or strike out.

On another note, it may also be desirable for pitchers to avoid falling into a pattern of simply throwing a pitch away from the batter immediately after delivering a purpose pitch toward the corresponding Purpose Zone. As an alternative, a pitcher may "double up," by throwing two successive purpose pitches inside on a batter in, as a means to avoid falling into a particular and/or recognizable pitch sequence pattern. In sum, fastballs at the protruding sections 130 are designed to prevent batters from directing their front sides or hips toward the strike zone 120 during the stride phase of a swing on successive pitches making it more difficult for batters to follow pitches with their eyes, especially pitches located along the outer third of the strike zone 120 away from a batter.

It is also contemplated that pitches other than those targeted for the Purpose Zones may be used as set up pitches. During a particular game type setting, the choice of set up pitches may be determined by one or more factors including, but not necessarily limited to (a) the actual batter making a place appearance, (b) how successful a pitcher has been at throwing certain pitches during the game, (c) how successful a pitcher has been at locating certain pitches during the game, (d) the actual game situation with regard to the score of the game, the number of base runners, the number of outs, the inning of the game, the next batter in the lineup, the weather and/or other environmental conditions such as the location of the sun, night game lighting, swarming insects, the fatigue level of the pitcher, and combinations thereof. Thus, the present throwing target 100 is an advantageous means for developing pitching effectiveness due to its inclusion of an array of zones in and around a designated strike zone 120.

Although the present throwing target 100 as discussed herein provides suitable protruding sections 130 for competitive game situations, it is also contemplated that the throwing target 100 not include protruding sections 130 for leisurely training purposes. It is also contemplated that the protruding section 130 opposite a batter may be used as a target zone for situational pitching, e.g., for intentional walks, pitchouts, and to set up a backdoor curveball, as each of these are understood by persons of ordinary skill in the game of baseball.

Target Zones 9 and 10

The top corner regions of the strike zone 120 shown as target zones 9 and 10 are herein referred to as "Freeze Zones." As illustrated in FIG. 5, the Freeze Zones 9 and 10 are located immediately above target zones 1 and 3. In one embodiment, Freeze Zones 9 and 10 may be designated as circular zones to assist in differentiating the Freeze Zones from the surround non-circular zones of the throwing target 100. In another embodiment, Freeze Zones 9 and 10 may be designated as rectangular or multi-sided zones. In another embodiment, the Freeze Zones 9 and 10 may be color coded in a similar manner as the other target and non-target zones. It should also be noted that the Freeze Zones 9 and 10, and other zones, may exclude using numbers altogether relying instead on a color coding scheme to set the Freeze Zones apart from the other target and non-target zones. Although not limited to a particular color or color combination, one suitable Freeze Zone color is blue and shades thereof. A blue color may serve as a reminder that the zones are "freeze" zones as blue is often associated with water and ice. In another embodiment, each of the Freeze Zones 9 and 10 may comprise different colors as desired.

It is Applicant's position that each of the Freeze Zones 9 and 10 may be effective pitch locations for producing a called third strike, a swing and miss, or to otherwise jam a batter with the pitch in on the batters hands with the intent of inhibiting the batter from extending his/her arms (and bat) out toward the pitched ball during a swing. In a situation where a pitcher throws an off-speed pitch early in a count for a called strike, or when a pitcher gets a batter to swing and miss at an off-speed pitch early in a count, a batter may thereafter have a tendency to expect that same pitch in counts 0-2, 1-2, and 2-2. A scenario where a batter sees off-speed pitches early in a count for strikes and then fastballs at the Freeze Zones 9 and 10 when behind in the count 0-2 or 1-2 is often referred to as "pitching backwards" by persons of ordinary skill in baseball since pitchers typically use the fastball to get ahead in a count and then off-speed pitches when batters are behind in the count. Training with the Freeze Zones 9 and 10 to develop pitching backwards may be effective for disrupting batters timing and rhythm by changing traditional pitch sequences. Pitching backwards may be an effective approach for those pitchers not having overpowering fastballs and off-speed pitches.

Typically, once a batter has seen an off-speed pitch for a strike the batter will attempt to protect the plate, especially with two strikes. Here, a pitcher may deliver a good four-seam fastball toward either of the Freeze Zones 9 or 10 to freeze the batter keeping him/her from swinging the bat. In other words, if a batter is expecting an off-speed pitch, and a pitcher throws a four-seam fastball at either of the Freeze Zones 9 or 10, the batter may be unable to readjust in time to swing at the pitch thereby "freezing" the batter in motion as the pitch is received by the hind catcher. The above mentioned use of the Freeze Zones 9 and 10 may also be useful when facing a batter in the later innings (innings 7, 8, and 9) where the pitcher struck out the same batter earlier in the game with an off-speed pitch or a breaking ball. It is when a batter is looking for, expecting, or otherwise guessing for an off-speed pitch that the Freeze Zones 9 and 10 may be most effective. If a batter does swing and contact a pitch located in either of the Freeze Zones 9 or 10 under the above described scenario, the result is often times simply a fouled pitch, i.e., foul tip, or pop up as these terms are known by persons of ordinary skill in the game of baseball.

In situations where a pitcher is ahead in a count 0-2 or 1-2, a batter may become aggressive, ready to swing the bat no matter the type of pitch and/or pitch location. If a pitcher misses the intended Freeze Zone 9 or 10 and the pitch is located down the middle of the strike zone 120 in non-target zone 11, an aggressive batter may actually make solid contact with the pitch. Thus, it may be important when training with the throwing target 100 to practice throwing a pitch at Freeze Zones 9 and 10 with the intention of missing away from the strike zone 120 toward the Purpose Zones, if one is to miss the intended Freeze Zone, thereby increasing the chance that the intended Freeze Zone pitch results in a purpose pitch within target zone 7 or 8 rather than a pitch in non-target zone 11.

In an advanced method of making use of the Freeze Zones, a pitcher may target a two-seam fastball toward the Freeze Zone 9 or 10 that is opposite arm side. Depending on the movement of a given individual's two-seam fastball, a two-seam fastball that is intended for the opposite arm side Freeze Zone should suitably start out from the pitcher's hand directed toward the opposite arm side Purpose Zone, whereby the ball moves during flight into the intended Freeze Zone as the pitch passes through the strike zone 120.

The two-seam fastball approach may also be effective during Freeze Zone counts or following a four-seam fastball located at a Purpose Zone when facing a particular batter. Here, backspin and exceptional command of the fastball are fundamental for effectively executing this advanced pitch. The above described pitch gives batters the illusion that the ball will pass through the strike zone 120 further inside toward the batter than where the pitch actually does pass, effectively freezing the batter.

It is Applicant's position that pitchers should be cautious of locating pitches out wide beyond target zones 7 and 8, especially when ahead in the count 0-2 or 1-2. This may result in a hit batsmen, thereby placing a base runner at first base when that particular batter may have been susceptible to a strike out pitch had he/she not been hit by the pitch. On the other hand, the other players on the opposing team may realize that the pitcher is not afraid to pitch inside, thereby giving the pitcher a mental advantage over the opposing teams batters for the remaining innings of the game, especially with regard to a pitcher that is otherwise successful at locating pitches along the outer third of the strike zone 120 away from batters as discussed above. Of further note, it is not recommended that pitchers locate pitches in the Freeze Zones 9 and 10 during a batter's count, e.g., an even count or when a batter is ahead in a count, since a pitch located in the Freeze Zones 9 and 10 generally travels along a flatter plane with less vertical drop allowing batters to make solid contact on the ball.

It is also contemplated that the Freeze Zones 9 and 10 may be desirable target zones for breaking balls having a tighter or later break, such as a "slider" pitch as commonly known by persons in the game of baseball—especially when facing arm side batters, e.g., target zone 9 for left-handed pitchers and target zone 10 for right handed pitchers. In one particularly advantageous embodiment, it may be desirable to aim a slider pitch at the arm side Freeze Zone to ensure that the pitch ends up traveling through the strike zone 120. Likewise, when making use of a slider to induce either a swing and miss or a called strike, it may be desirable to direct a slider toward the middle of the strike zone 120, so that the pitch will suitably break to a Chase Zone away from the batter.

K Zones

The K Zones located adjacent the bottom corners of the strike zone 120 are suitable locations to target pitches in two strike count situations including, but not necessarily limited to 0-2, 1-2, and 2-2 counts in an attempt to strike out a batter swinging or taking the pitch. With reference to FIG. 5, when batters are behind in a count with two strikes they commonly swing at pitches located outside of the strike zone 120 (aka—"expanding their strike zone") for pitches located: (1) below the Go Zones through Chase Zone 4, (2) below Chase Zone 4, (3) in Chase Zones 5 and 6, (4) out beyond Chase Zones 5 and 6, and (5) pitches located in non-target zone 12. As such, pitches passing through the K Zones may be suitable two strike pitch locations especially since batters are less likely to make solid contact on K Zone pitches since it is typically difficult for batters to get the plane of the bat on the plane of a pitched ball directed toward the K Zones.

Moreover, K Zone pitches may be called strikes where an umpire is in a rhythm as to seeing certain pitches from a particular pitcher, or where an umpire has a generous or larger than normal strike zone for calling strikes. Also, if the hind catcher sets his/her catchers mitt at a K Zone location and the pitcher hits the mitt, an umpire may perceive the pitch as being within the strike zone 120. However, if a catcher sets his/her mitt within the strike zone 120 and has to reach downward toward a K Zone to receive a pitch, an umpire may be less likely to call a strike since the umpire may be visually swayed by the downward movement of the catchers mitt thereby perceiving the pitch as being located outside of the strike zone 120.

The K Zones of the throwing target 100 may also be used to develop a pitcher's breaking ball pitches opposite arm side. In an example where a batter has expanded his/her strike zone when behind in a count, it is Applicant's position that a pitcher may aim a breaking ball pitch toward non-target zone 11 or in the arm side Freeze Zone so that the pitch will come out of the pitcher's hand appearing to a batter as a hittable pitch up in non-target zone 11. If the pitch has good tilt and depth it should break down in flight from non-target zone 11 or the upper part of the strike zone 120 to the intended K Zone. In other words, batters may be more likely to swing at this type of pitch since the pitch travels for a period of time up in what appears to the batter as a hittable pitch directed toward non-target zone 11.

To be effective in game type situations, a pitcher may use the throwing target 100 to reference exactly where to initially direct a K Zone breaking ball pitch depending on the amount of break on that particular pitcher's breaking ball. For example, if a pitcher throws a slider or cut fastball, i.e., a pitch having a tight, short break, then the pitcher may start the pitch at the corresponding opposite arm side Go Zone 1 or 3. But if a pitcher has more downward movement on a particular breaking ball pitch, he/she may start the pitch toward the corresponding arm-side Freeze Zone to allow for the added downward movement on the pitched ball. In sum, breaking ball pitches intended for the K Zones should appear to batters as pitches directed toward the strike zone 120 for as long as possible before breaking down out of the strike zone 120 into the intended K Zone.

When a pitcher is ahead in the count, the change-up pitch may be another pitch choice for directing toward the K Zones. Typically, if a pitcher starts a change-up at the arm side at the bottom of the Go Zone 1 or 3 with desired backspin on the ball, gravity and natural ball movement suitably directs the pitch toward the nearest K Zone. Here, change-ups should be initially directed toward the outer third of the Go Zone through the first half of the ball's flight, at the time when a batter has to make a decision whether to swing at the pitch. Desirably, the movement on the pitch will direct the ball toward the nearest K Zone. The K Zones may also be targeted opposite arm side with a change-up pitch although it is Applicant's position that such a pitch may be more difficult to execute than the arm-side change-up. For effective opposite arm side change-up execution, it is typically necessary to place backspin on the ball because a change-up with sidespin opposite arm side may undesirably travel through non-target zone 11.

Two-seam and four-seam fastballs targeted for the K Zones may be desirable pitches especially when a pitcher is ahead in a count with two strikes, allowing a pitcher to expand the strike zone 120. In addition, a two seam fastball may be directed toward either K Zone in a double play situation. Here, a two-seam fastball is suitably thrown toward the arm side third of the Go Zone and thereafter is directed toward the K Zone once the batter has decided to swing at the pitch. In the alternative, if throwing a two-seam fastball opposite arm side, it is Applicant's position that the amount of backspin placed on the ball is valuable for promoting downward movement of the pitch toward the opposite arm side K Zone. In summary, the K Zones may be desirable for locating two seam fastballs for producing ground balls in double play situations, or for locating four seam fastballs when a batter must expand his/her strike zone.

The K Zones of the throwing target 100 may also be used as backdoor curveball locations when pitchers are ahead in a count. As understood by persons of ordinary skill in the game of baseball, backdoor curveballs are thrown when facing opposite arm side batters.

Non-Target Zones 11 and 12

Generally, non-target zones 11 and 12 are pitch locations to avoid. It is Applicant's position that the most desirable region of the strike zone 120 to avoid is that region predominately above target zone 2 designated as non-target zone 11. In other words, pitchers should attempt to locate strike zone 120 pitches only within the target zones. Pitches that end up located in non-target zone 11 are typically flat and susceptible to being contacted solidly by a batter as discussed above. As shown in FIG. 5, non-target zone 11 is located in at least the upper half and middle third of the strike zone 120. Although not necessarily limited to a particular size, a suitable non-target zone 11 may comprise up to about 30.0 percent of the total surface area of the strike zone 120.

As depicted in the various views of the throwing target 100, non-target zone 12 is located immediately above the designated strike zone 120 and non-target zone 11. In other versions of the throwing target 100 non-target zones 11 and 12 may comprise a single zone not including an upper most border of the strike zone 120 separating the two zones. In the alternative, non-target zone 12 may include a plurality of smaller zones configured as desired. Although typically a non-desirable pitch location, it is contemplated that non-target zone 12 may be used as an intended pitch location for example if a particular batter has trouble laying off fastballs located from about the upper part of the strike zone 120 to about the batter's eyes. In another example, a successive pitch may be targeted for the non-target zone 12 where a batter first swings and misses, or swings late, at a fastball located near the top of non-target zone 11. Here, a pitcher may thereafter successfully entice a batter to swing at the next pitch that is located a little higher than the previous zone 11 pitch. The philosophy here is to keep throwing the fastball higher and higher until the batter is no longer willing to swing at the pitch. Such pitching methodology is commonly termed "climbing the ladder" by persons of ordinary skill in the art of baseball and is generally used when facing batters (1) having slower than average bat or swing speed, (2) where a pitcher has exceptional velocity on his/her fastball, and (3) combinations thereof.

It is Applicant's position that once a pitcher has delivered two or three fastballs from about the top of the strike zone 120 and above to a particular batter, the batter may thereafter be set up for an off-speed pitch, such as a change-up or breaking ball suitably directed toward the bottom most portion of the Go Zones or toward target zone 4. The above described pitching sequence is an example of changing both the velocity and location of pitches (consecutive or non-consecutive pitches) in an attempt to disrupt a batter's timing, hopefully resulting in an out.

As described in Table 1, non-target zones 11 and 12 may be color coded with any color or color combination as desired. In one suitable embodiment, non-target zones 11 and 12 are color coded red to signify "danger" to the individual using the throwing target 100. Regardless of the color(s) used, the throwing target 100 should display non-target zones 11 and 12 in a manner effective to relay or remind pitchers to generally avoid these zones for reasons explained above.

In terms of pitching strategy, it is Applicant's position that it is often times just as important to throw pitches up and down, i.e., high and low, as it is to throw pitches inside and outside with regard to the strike zone 120. It is also Applicant's position that a pitcher maximizes his/her ability to disrupt a batter's timing by (1) mixing successive pitches in/out/high/low, (2) changing the velocity of successive pitches, (3) changing the type of pitch being thrown as it relates to movement on the pitch, (4) changing the release point of the baseball from the throwing hand, (5) using the same release points and initial pitch paths in space for his/her various pitches to maximize pitch deception, and combinations thereof.

In order to make ample use of the throwing target 100, it is Applicant's position that a pitcher should visualize the target zones and non-target zones during actual game type situations. Pitchers should also communicate with the hind catcher regarding pitch location and pitch sequences in relation to the strike zone 120, target zones and non-target zones as envisioned by the pitcher in relation to each batter making a plate appearance. During training, the throwing target 100 is operationally configured to develop pitch location and the muscle memory associated therewith. In addition, an individual may find pitching more enjoyable if he/she has greater command of pitches and various zones discussed herein.

It is also contemplated that the throwing target 100 may be used to enhance and/or develop and/or train the act of pitching away from a batter along the outer third of the strike zone 120 when facing a batter that is a predominantly "dead pull hitter" as the phrase is known by those of ordinary skill in the game of baseball. Often times, a pitch delivered to the outer third of the strike zone 120 away from a dead pull hitter results in the batter hitting the pitch to the side of the infield correlating to the side of the plate from which he/she is batting, e.g., a Lefty pulling an outside pitch resulting in a ground ball hit toward the second baseman; a Righty pulling an outside pitch resulting in a ground ball hit toward the shortstop. These types of ground balls are often referred to as "routine ground balls" by those of ordinary skill in the game of baseball meaning that such hit ball results in a put-out more often than a base hit. Although not limited to any particular type of pitch, suitable pitches to deliver in hope of producing a routine ground ball from a dead pull hitter include two-seam and four-seam fastballs located on the outer third of the strike zone 120 away from the batter.

It is also contemplated that batters may make use of the overall layout of the throwing target 100, including the layout of the target zones 104 and non-target zones 106 in relation to their particular strike zone 120. In one aspect, the throwing target 100 may be used by batters to realize their own strengths and weaknesses as to pitch location—further developing their batting skills by referencing the throwing target zones 104, 106 as to success/failure of hitting pitches and/or attempting to hit pitches at various locations in and around the strike zone 120. For example, the throwing target 100 may be used by batters to distinguish pitches desirable to swing for versus pitches undesirable to swing for. In a practice situation or simulated game situation where a pitcher is using the throwing target 100, a video camera may be used to record every pitch from behind the mound, i.e., from behind the pitcher, so that the video footage may be evaluated as to batter strengths/weaknesses regarding certain pitches and pitch locations. The throwing target 100 may even be used by individuals to chart particular pitchers/batters as seen on television, or like medium, as desired.

It is further contemplated that the throwing target 100 may be used to chart batters and/or pitchers on an at-bat basis by recording one or more of the following for each pitch: (1) the pitch location, (2) the pitch type, (3) whether the pitch was called a ball or a strike, and (4) whether the pitch was contacted solidly. In one example, batters may be charted according to strengths/weaknesses in relation to pitch location according to the throwing target 100 and pitchers may use this information and incorporate such into practice sessions/bullpen sessions in preparation to face a particular team or batter(s). Through use of the throwing target 100, pitchers may improve their sequential thought process by utilizing the specific target zones 104 and non-target zones 106 as reference locales in preparation for facing a particular batter instead of having to rely on less specific pitch locations based off of a simple rectangular strike zone. Thus, the present throwing target 100 is operationally configured to (1) provide detailed spots for locating (or not locating) various pitches, and (2) provide an accurate means for relaying information to another concerning batter and/or pitching performance.

In yet another embodiment, data gathered or charted using the throwing target 100 may be computerized, and thereafter used to: (1) calculate favorable pitch scenarios and pitch locations when facing certain batters in various game situations and pitch counts based on past pitching outings, (2) develop or configure a pitcher's training session(s) or bullpen session(s) based on past pitching outings, (3) train batters to swing/not swing for particular types of pitches based on past at-bats, and combinations thereof. Here, the throwing target 100 may be used during game settings to gather data to design a particular pitching program for an individual incorporating predetermined pitch sequences to use during practice or bullpen sessions with the throwing target 100 for developing one or more pitching attributes. It is further contemplated that software may be used to collect, store and display data gathered for the purpose of educating pitchers as to various pitching strategies. A computerized application may include use of a touch screen effective for recording information relating to pitches thrown during practice sessions. Information gathered may include, for example, the hit/miss ratio of selected zones for each practice session. It is also contemplated that computerized data may be downloaded from the internet.

In still another embodiment, computer generated information from data collected on a batter's previous at-bats and various pitch locations in relation to the throwing target 100 may be used to program a pitching machine to deliver certain types of pitches to a batter for training purposes. For example, if wanting to train a batter to refrain from swinging at a particular type of pitch in a particular location in or around the strike zone 120, a pitching machine may be programmed to deliver particular types of pitches toward the throwing target 100 as necessary to train a batter to recognize the types of pitches that he/she should refrain from swinging. A pitching machine may also be programmed to deliver pitches most favorable for a particular batter to swing for. In addition, a pitching machine may be programmed to deliver a pitch sequence based on charted information concerning a particular pitcher whereby a batter can train by seeing actual pitch types and pitch sequences as determined for a particular pitcher based on charting the pitcher according to the present throwing target 100.

It is also contemplated that baseball scouts, coaches, instructors and other individuals making evaluations of pitchers and batters may implement the throwing target 100 as a general reference or guide for (1) grading pitchers/batters, (2) critiquing pitchers/batters, (3) training pitchers/batters by monitoring player performance over time, (4) relaying information, e.g., scouting reports, to other individuals that have a working knowledge of the throwing target 100 with regard to the grading, critiquing, training of particular baseball players. In one method of use, the throwing target 100 may be used like a grid, whereby pitch location and pitch type are marked onto a throwing target 100 in any manner effective for individuals to thereafter make use of the information that is charted. For example, an advance baseball scout may make use of a throwing target 100 printed on a sheet of paper and mark on the paper the location of an opposing team's pitches using a pen/pencil/marker, etc. Based on the scout's charted markings, it may be discovered that a particular opposing pitcher always starts off an at-bat by throwing a first pitch fastball toward a particular zone. The team may thereafter use the scout's information to train its batters to expect a first pitch fastball in a more precise spot than may otherwise be available. If the first pitch is typically directed toward a zone that is a high percentage base hit zone for a batter, the scout's information may be valuable in assisting the batter's timing during the at-bat.

It is also contemplated that the throwing target 100 and similar techniques as discussed above may be used to grade, critique, train, and develop umpires as to calling balls and strikes. It is even further contemplated herein, that the instant throwing target 100 may be used by an organization, e.g., a professional sports team, a college sports program, the baseball scouting bureau, Olympic Baseball/Softball programs, and the like, as a standardized basis for analyzing its own pitchers or prospective pitchers as to individual pitching success, pitching development, pitching potential, and a pitcher's measured improvement over time. For example, professional baseball scouts for a particular baseball team or organization may evaluate amateur pitchers based on a commonly accepted throwing target 100 configuration for the organization, and thereafter forward their scouting reports to their superiors in the organization to make organizational decisions as they relate to the amateur draft, player moves, player acquisitions, and player trades.

In another aspect, it is valuable for hind catchers to have a working understanding of the layout of the throwing target 100 and that catchers have a substantially similar mental image of the various target zones 104 and non-target zones 106 as the pitcher as they relate to a particular batter during a game type situation. The throwing target 100 of this application may also be effective for freeing up a catcher's time during practice to work on other parts of his/her game rather than having to spend time catching pitchers during bullpen sessions since pitchers can utilize the throwing target 100 rather than an actual catcher.

The invention will be better understood with reference to the following non-limiting examples, which are illustrative only and not intended to limit the present invention to a particular embodiment.

Example 1

In a first non-limiting example, a throwing target 100 is provided for developing and training the management of a baseball strike zone 120 during a practice session, for example, a bullpen session. The following is an exemplary pitch sequence guide for developing pitch performance using the throwing target 100:

| Number of Pitches | Pitch Details |
|---|---|
| 6 | Alternate delivering the following pitch types, each pitch targeted for target zone 2:<br>(1) Two-seam fastball<br>(2) Change-up<br>Effort should be made to have good backspin on the ball. |
| 2 | Four-seam fastball targeted for the opposite arm side target zone 1 or 3. |

-continued

| Number of Pitches | Pitch Details |
|---|---|
| 2 | Two-seam fastball targeted for the arm side target zone 1 or 3. |
| 1 | Four-seam fastball targeted for the opposite arm side target zone 7 or 8. |
| 1 | Off speed pitch targeted for target zone 2.<br>This pitch being applicable for the following counts:<br>(1) 0-0, attempting a first pitch strike<br>(2) Even counts<br>(3) When pitcher is behind in the count |
| 1 | Four-seam fastball targeted for the opposite arm side target zone 7 or 8. |
| 1 | Off speed pitch targeted for the opposite arm side target zone 1 or 3, or alternatively targeted for target zone 4.<br>This pitch being applicable for following counts:<br>(1) 0-1<br>(2) 1-2 |
| 2 | Two-seam fastball targeted for target zone 4.<br>This pitch being applicable for following game situation:<br>(1) baserunners on base with less than 2 outs, pitcher desiring a first pitch strike. |
| 1 | Two-seam or four-seam fastball targeted for the arm side target zone 9 or 10 or target zone 5 or 6. |
| 1 | Change-up targeted for opposite arm side target zone 4, 5 or 6.<br>Purpose of Pitch: Strikeout or base on balls.<br>This pitch being applicable for following counts:<br>(1) 0-2<br>(2) 1-2 |
| 1 | Four-seam fastball targeted for the opposite arm side target zone 9 or 10, or target zone 5 or 6. |
| 1 | Change-up targeted for the opposite arm side target zone 5 or 6.<br>Purpose of the Pitch: A strikeout or base on balls (or "walk"). |
| 2 | Four-seam fastball targeted for the opposite arm side target zone 1 or 3.<br>Effort should be made to have good backspin on the ball. |

In this example, there are a total of thirty pitch variations, i.e., pitch type and pitch location, that may be used in any number of pitch sequences. For example, a suitable sequence session may include three ten pitch sequences—mixing and matching the above described pitches as desired. For example, the first four pitches may be delivered twice for a total of eight pitches, followed by two more desired pitches to complete the ten pitch sequence. Pitchers may use the throwing target 100 either from a full windup position or from a stretch position when delivering pitches. In addition, pitchers may chart their success/failure in hitting the desired zones on the throwing target 100 when delivering his/her various types of pitches. Such collected data may be used to evaluate pitching improvement or skill over time.

Example 2

Figure 19:
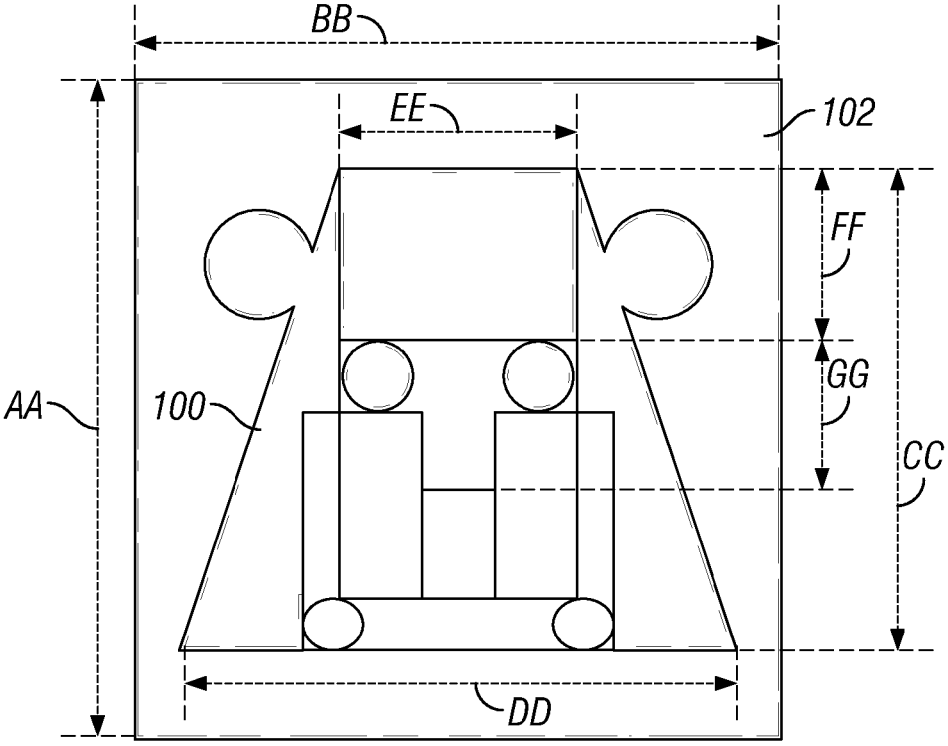
FIG. 19 illustrates a front elevational view of an embodiment of the throwing target on a target surface.

In a second non-limiting example, a throwing target 100 is provided for training the management of a baseball strike zone 120. A throwing target, as shown in FIG. 19, is provided having the following dimensions:

Target Surface 102

Height (AA): about 177.8 cm; about 70.0 inches

Width (BB): about 127.0 cm; about 50.0 inches

Canvas: about 339.0 g/m$^2$; about 10.0 ounces per square yard

Strike Zone 120

Height: about 46.99 cm; about 18.5 inches

Width: about 41.91 cm; about 16.5 inches

The bottom most border of the strike zone 120 being set about 43.18 cm (about 17.0 inches) above ground level.

Target Zones

Height (CC): about 88.90 cm; about 35.0 inches

Width (DD): about 106.7 cm; about 42.0 inches

Diameter at Zone 7: about 20.32 cm; about 8.0 inches

Diameter at Zone 8: about 20.32 cm; about 8.0 inches

Diameter of Zone 9: about 12.70 cm; about 5.0 inches

Diameter of Zone 10: about 12.70 cm; about 5.0 inches

Width of Zones 1, 2, 3: about 13.97 cm each; about 5.5 inches each

Height of Zone 4: about 10.16 cm; about 4.0 inches

Non-Target Zones

Width (EE): about 41.91 cm; about 16.5 inches

Height (FF): about 30.48 cm; about 12.0 inches

Height (GG): about 27.94 cm; about 11.0 inches

Suitably, the bottom most border of the throwing target 100 is set about 15.24 cm (about 6.0 inches) above ground level.

Example 3

Figure 20:
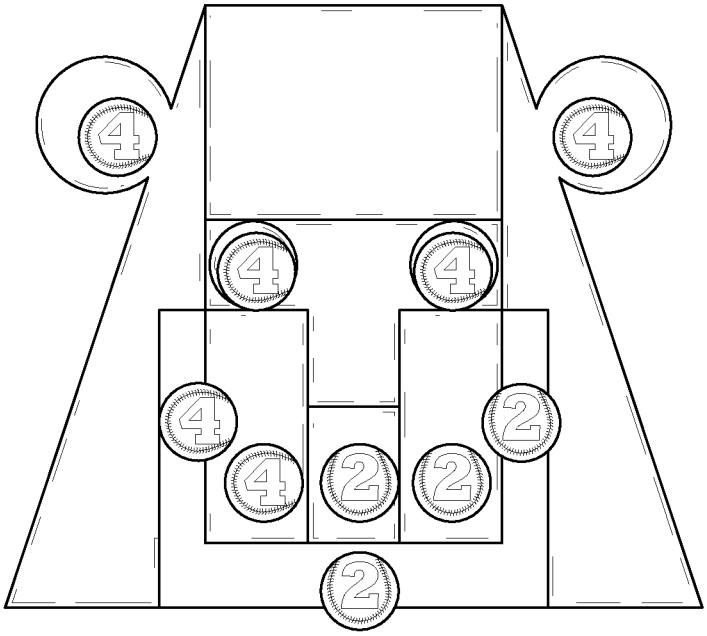
FIG. 20 illustrates a front elevational view of an embodiment of the throwing target having both two seam and four seam fastball location indicators for right handed throwing pitchers as determined by Applicant.
Figure 21:
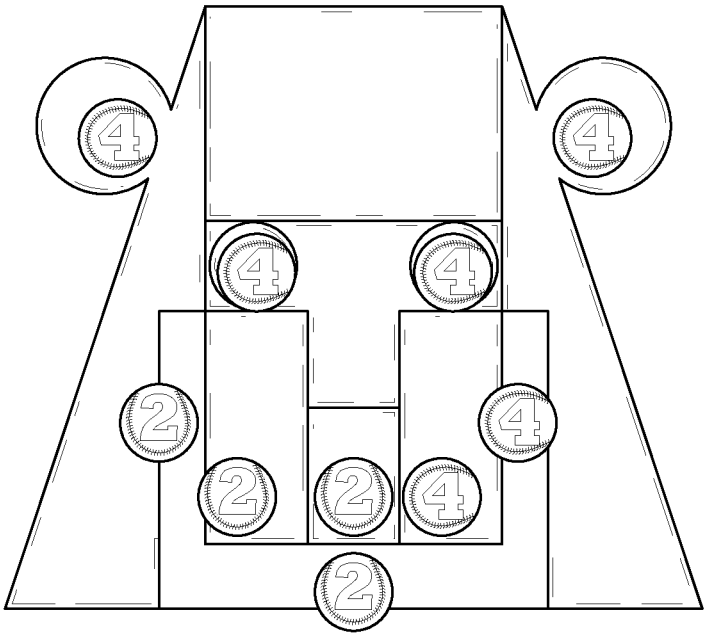
FIG. 21 illustrates a front elevational view of an embodiment of the throwing target having both two seam and four seam fastball location indicators for left handed throwing pitchers as determined by Applicant.

In a third non-limiting example, a throwing target 100 is provided including markings representing suitable pitch locations for both two-seam and four-seam fastballs. For example, FIG. 20 is representative of a throwing target 100 having both two-seam and four-seam fastball locators for right handed pitchers. FIG. 21 is representative of a throwing target 100 having both two-seam and four-seam fastball locators for left handed pitchers.

Persons of ordinary skill in the art will recognize that many modifications may be made to the embodiments described above without departing from the broad inventive concept thereof. The embodiments described herein are meant to be illustrative only and should not be taken as limiting the invention.

I claim:

1. A method of training an individual's management of a baseball strike zone while performing the act of pitching comprising:

providing a throwing target, the throwing target having a border including two obtuse angles defined by a distance there between, the throwing target having a designated baseball strike zone therein of a particular height and width, a plurality of zones outside of the strike zone assigned as zones for locating thrown pitches and at least one zone outside of the strike zone assigned as a zone to avoid locating thrown pitches, wherein the vertices of the obtuse angles are separated from the strike zone by both zones assigned as zones for locating pitches and at least one zone assigned to avoid locating pitches;

targeting a particular zone for locating a particular type of pitch; and delivering a pitch in an attempt to contact the zone targeted.

2. The method of claim 1 wherein the strike zone includes one or more zones therein assigned as zones for locating thrown pitches and at least one zone therein assigned as a zone to avoid locating thrown pitches.

3. The method of claim 1 wherein the throwing target may be used to monitor an individual's pitching performance by charting the location of an individual's pitches on the throwing target over time.

4. The method of claim 1 wherein the throwing target may be used to collect information regarding an individual's pitching tendencies in game situations.

5. The method of claim 1 wherein the distance between the vertices of the obtuse angles is about equal to the width of the strike zone.

6. The method of claim 1 wherein particular types of pitches are selected from the group consisting of fastball pitches and off-speed pitches.

7. The method of claim 1 further comprising providing an individual with a particular game scenario prior to the individual delivering a pitch toward the throwing target.

8. The method of claim 7 wherein the game scenario includes a particular pitch count, a particular game situation, and a particular batter.

9. The method of claim 1 further comprising determining a particular zone to aim the pitch upon release of the ball from the hand, the aimed for zone being different than the intended zone of contact of the ball on the throwing target.

10. The method of claim 6 wherein the throwing target may be used to prepare for facing a particular batter by delivering one or more pitches toward one or more particular zones based on information known about the batter.

* * * * *